US009929502B2

(12) United States Patent
Zhang

(10) Patent No.: US 9,929,502 B2
(45) Date of Patent: Mar. 27, 2018

(54) ELECTRICAL CONNECTOR AND CABLE CONNECTOR HAVING SAME

(71) Applicant: Molex, LLC, Lisle, IL (US)

(72) Inventor: Xue-Hai Zhang, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/325,148

(22) PCT Filed: Jul. 10, 2015

(86) PCT No.: PCT/CN2015/083769
§ 371 (c)(1),
(2) Date: Apr. 17, 2017

(87) PCT Pub. No.: WO2016/004895
PCT Pub. Date: Jan. 14, 2016

(65) Prior Publication Data

US 2017/0229810 A1 Aug. 10, 2017

(30) Foreign Application Priority Data

Jul. 11, 2014 (CN) ..... 2014 1 0331375

(51) Int. Cl.
*H01R 13/627* (2006.01)
*H01R 13/502* (2006.01)
(Continued)

(52) U.S. Cl.
CPC ..... *H01R 13/6273* (2013.01); *H01R 13/502* (2013.01); *H01R 13/6581* (2013.01);
(Continued)

(58) Field of Classification Search
None
See application file for complete search history.

(56) References Cited

U.S. PATENT DOCUMENTS 7,976,350 B2 * 7/2011 Ho ..... H01R 9/031 439/607.51
8,998,632 B2 4/2015 Golko et al.
(Continued)

FOREIGN PATENT DOCUMENTS

CN 201094142 Y 7/2008
CN 203367633 U 12/2013
TW M477704 U 5/2014

*Primary Examiner* — Harshad C Patel
(74) *Attorney, Agent, or Firm* — James A. O'Malley

(57) ABSTRACT

An electrical connector and a cable connector having the electrical connector are disclosed. The electrical connector includes an insulating housing, first and second modules, two conductive latching members, a shielding piece, two conductive elastic sheets, and an outer shielding shell. Each module has an insulating member and a group of conductive terminals. The shielding piece has a plate body and two grounding portions. The plate body separates the conductive terminals of the first module from the conductive terminals of the second module. The grounding portion contacts and electrically connects with the conductive latching members. The conductive elastic sheets are mounted on an outer side of the insulating housing. The outer shielding shell encloses an outer periphery of the two conductive elastic sheets, the two conductive latching members and the insulating housing. The present disclosure can promote signal transmitting quality during high speed data transmission.

29 Claims, 18 Drawing Sheets

(51) Int. Cl.

| | |
|---|---|
| ***H01R 13/6585*** | (2011.01) |
| ***H01R 13/6581*** | (2011.01) |
| ***H01R 24/60*** | (2011.01) |
| *H01R 107/00* | (2006.01) |

(52) U.S. Cl.
CPC ..... *H01R 13/6585* (2013.01); *H01R 24/60* (2013.01); *H01R 2107/00* (2013.01)

(56) References Cited

U.S. PATENT DOCUMENTS

| | | | | |
|---|---|---|---|---|
| 9,093,806 | B1 * | 7/2015 | Yang | H01R 24/60 |
| 9,281,626 | B2 | 3/2016 | Lin et al. | |
| 9,300,095 | B2 | 3/2016 | Lin et al. | |
| 9,312,641 | B2 | 4/2016 | Wang et al. | |
| 9,385,484 | B2 * | 7/2016 | Chen | H01R 13/6582 |
| 9,525,244 | B1 * | 12/2016 | Hsu | H01R 13/6585 |
| 9,711,887 | B1 * | 7/2017 | Hu | H01R 13/502 |
| 9,768,568 | B1 * | 9/2017 | Jin | H01R 24/60 |
| 2006/0148319 | A1 | 7/2006 | Huang | |
| 2010/0285684 | A1 * | 11/2010 | Zhang | H01R 13/6275 439/357 |

* cited by examiner

ELECTRICAL CONNECTOR AND CABLE CONNECTOR HAVING SAME

RELATED APPLICATIONS

This application is a national stage application of International Application No. PCT/CN2015/083769, filed Jul. 10, 2015, which claims priority to Chinese Patent Application No. 201410331375.6, filed Jul. 11, 2014, both of which are incorporated herein by reference in their entireties.

TECHNICAL FIELD

The present disclosure relates to an electrical connector, and particularly relates to an electrical connector suitable for high speed data transmission.

BACKGROUND ART

Chinese patent CN201180034957.2 discloses a receptacle electrical connector, referring to FIG. 38 through FIG. 41 of this patent, the electrical connector includes a housing having a defined cavity, two combined modules which are mounted in the defined cavity and which each are composed of a dielectric block and a contact set, two conductive retention member mounted on two sides of the housing for spring-loading, two metal shielding layers which are respectively mounted on a bottom portion and a top portion of the housing and soldered together and one electromagnetic interference (EMI) gasket mounted on an opening of a front end of the housing. Herein, the contact set of each combined module is composed of six contacts, the two contact sets are respectively arranged at a bottom portion and a top portion of the defined cavity. Each conductive retention member is positioned at a side surface of the housing and extends into the defined cavity from the side surface, a rear end of each conductive retention member is provided with a pin which may be correspondingly soldered to a pad on an applied circuit board, so that the conductive retention members may not only be used to secure a mating plug connector in the defined cavity, but also provide grounding paths for the mating connector. The electrical connector in the prior art provides the grounding paths only via the two conductive retention members, the grounding paths are less, which is not beneficial to discharge noise signals, in addition, because an interval between the two contact sets which oppose each other along an up-down direction is quite small, crosstalk between the two contact sets easily occurs in the electrical connector during signal transmission in high frequency and high speed, thus the electrical connector cannot be well suitable for high speed data transmission.

SUMMARY

A technical problem to be resolved by the present disclosure is to provide an electrical connector to overcome the deficiency in the prior art, which can reduce crosstalk and promote signal quality during high speed data transmission of conductive terminals.

In view of above technical problem, the present disclosure provides an electrical connector, which is suitable for correspondingly inserting into another mating connector, the electrical connector includes an insulating housing, the insulating housing has a bottom wall, a top wall opposing the bottom wall and two side walls connected between the bottom wall and the top wall, the bottom wall, the top wall and the two side walls enclose to form one mating cavity, the bottom wall and the top wall are respectively provided with a group of first terminal grooves and a group of second terminal grooves, each side wall is provided with one latching groove; a first module which is provided to a rear side of the insulating housing; the first module includes a first insulating member and a group of first conductive terminals fixed to the first insulating member, each first conductive terminal includes a fixed portion embedded in the first insulating member, a contacting portion extending forward from the fixed portion and a tail portion extending rearward from the fixed portion, the contacting portions of the first conductive terminals are received in the first terminal grooves and protruding toward the mating cavity; a second module which opposes the first module along an up-down direction and is engaged with the first module together, the second module includes a second insulating member and a group of second conductive terminals fixed to the second insulating member, each second conductive terminal includes a fixed portion embedded in the second insulating member, a contacting portion extending forward from the fixed portion and a tail portion extending rearward from the fixed portion, the contacting portions of the second conductive terminals are received in the second terminal grooves and protruding toward the mating cavity; at least a conductive latching member, the conductive latching member includes a fixating portion and an elastic latching portion extending forward from the fixating portion, the elastic latching portion extends into the mating cavity via the latching groove of the insulating housing; a shielding piece which includes a plate body and two grounding portions respectively extending from two sides of the plate body, the plate body separates the first conductive terminals from the second conductive terminals, the grounding portion contacts and electrically connects with the conductive latching member; at least a conductive elastic sheet, the conductive elastic sheet includes a body mounted on an outer side of the insulating housing and a first contact portion extending inwardly from the body and extending into the mating cavity; and an outer shielding shell which encloses an outer periphery of the conductive elastic sheet, conductive latching member and insulating housing, and when the electrical connector is correspondingly inserted into another mating connector, the outer shielding shell electrically connects with the conductive elastic sheet and/or the conductive latching member.

In view of above technical problem, the present disclosure further provides a cable connector, the cable connector includes the electrical connector as above, a shielding shell mounted on a rear end of the electrical connector, an insulating outer shell covering an outer periphery of the shielding shell and a cable electrically connecting with the electrical connector together.

In comparison with the prior art, in the electrical connector and the cable connector with the electrical connector of the present disclosure, a shielding piece is provided between the first conductive terminals and the second conductive terminals, and the shielding piece is grounded via the conductive latching member, crosstalk between the first conductive terminals and the second conductive terminals may effectively shielding; in addition, the conductive elastic sheet is provided, the outer shielding shell can be grounded by that the conductive elastic sheet contacts the inner shielding shell of the mating connector, more grounding paths may be provided, so that signal transmitting quality can be promoted during high speed data transmission, and it is beneficial to maintain completeness of the outer shielding shell so as to prevent electromagnetic radiation leakage.

DETAILED DESCRIPTION OF THE PREFERRED EMBODIMENTS

Figure 1:
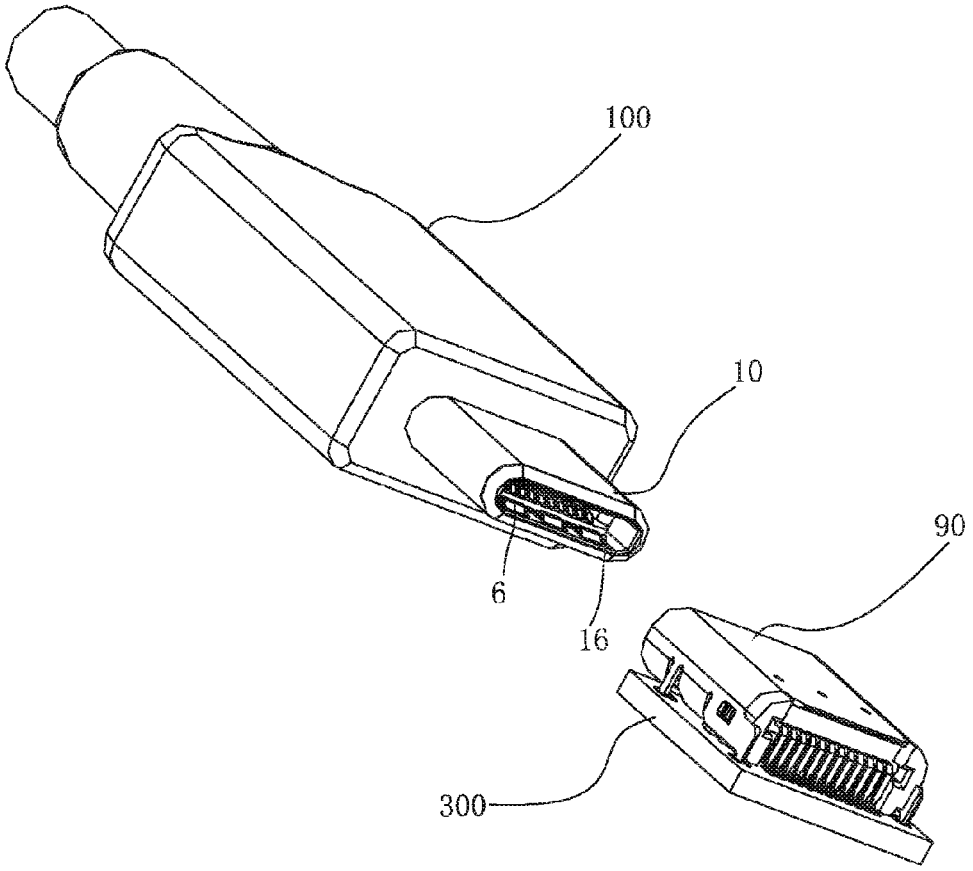
FIG. 1 is a perspective view of a cable connector of the present disclosure and another mating connector mounted on a circuit board.
Figure 2:
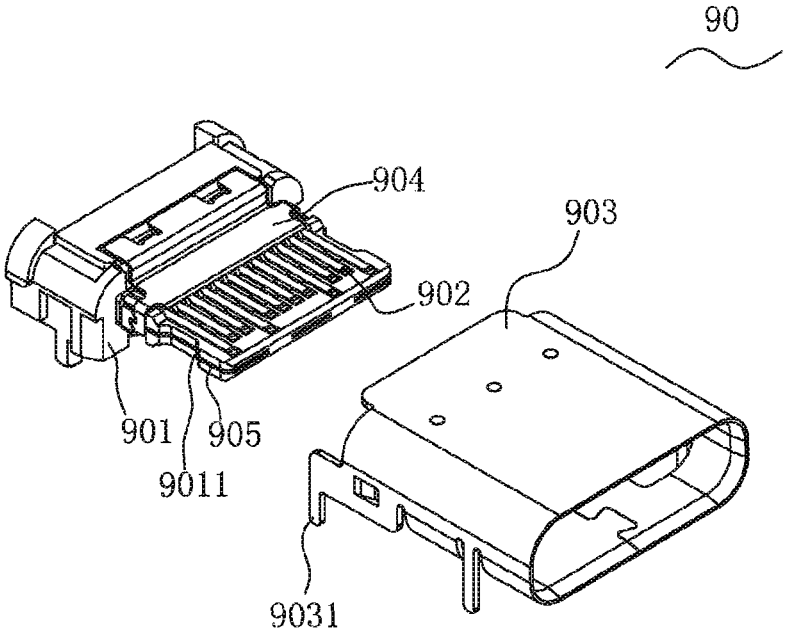
FIG. 2 is an exploded perspective view of the mating connector as shown in FIG. 1.
Figure 3:
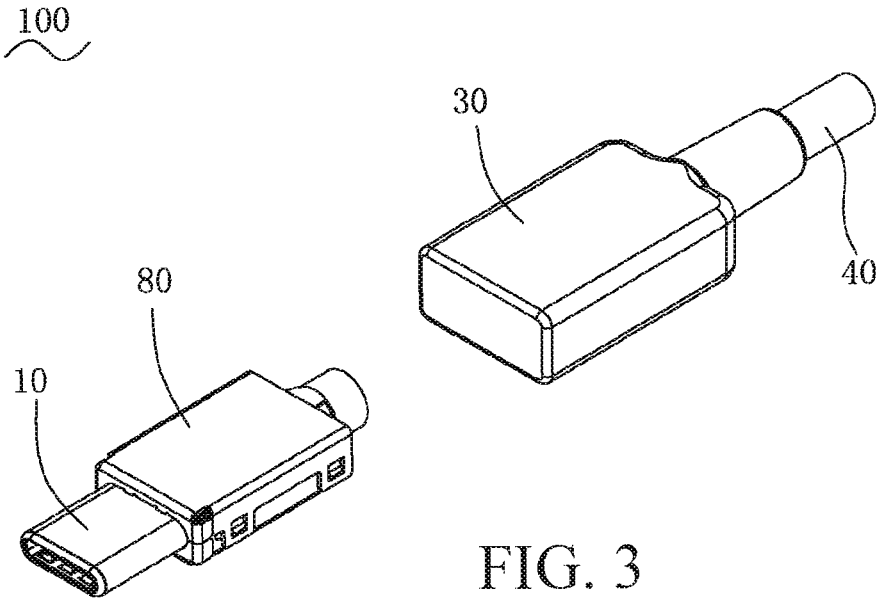
FIG. 3 is an exploded perspective view of the cable connector as shown in FIG. 1.
Figure 4:
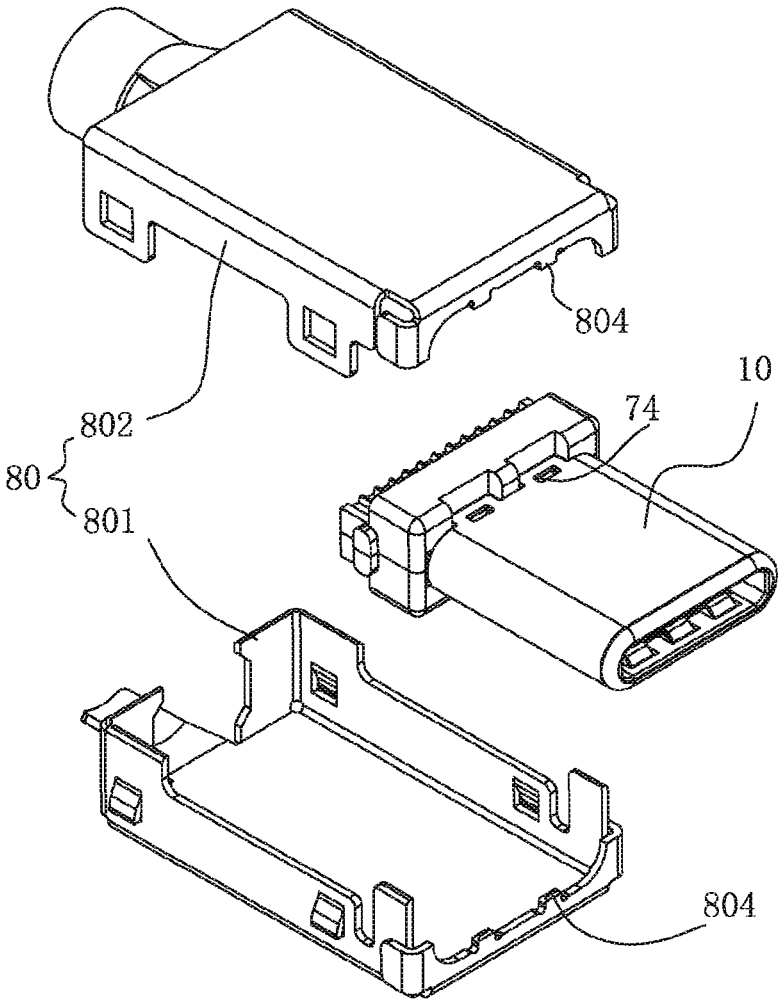
FIG. 4 is an exploded perspective view of an electrical connector and a shielding shell of the cable connector as shown in FIG. 3.
Figure 5:
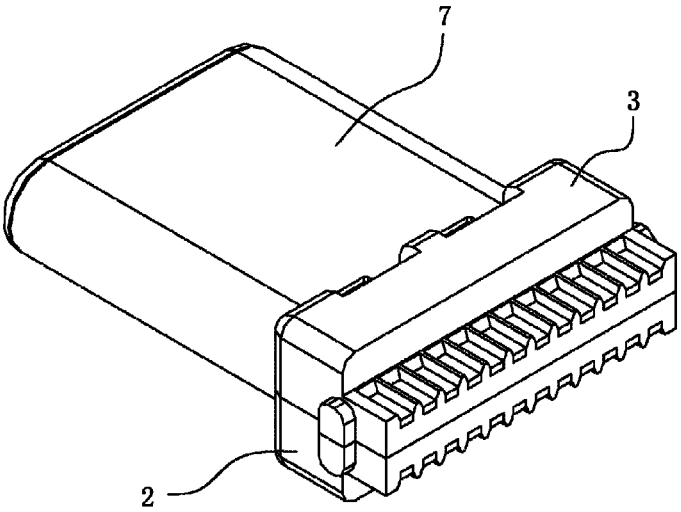
FIG. 5 is a perspective view of a first embodiment of the electrical connector of the present disclosure.
Figure 6:
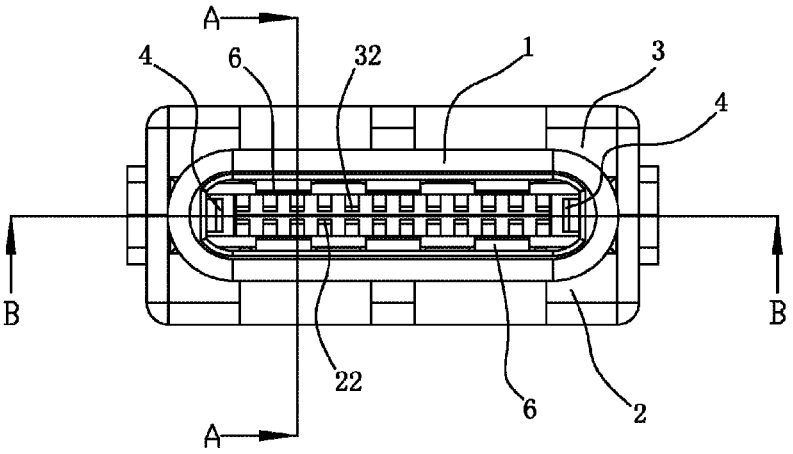
FIG. 6 is a front view of the electrical connector as shown in FIG. 5.

While the present disclosure may be susceptible to embodiment in different forms, there is shown in the figures, and will be described herein in detail, specific embodiments, with the understanding that the present disclosure is to be considered an exemplification of the principles of the present disclosure, and is not intended to limit the present disclosure to that as illustrated.

As such, references to a feature are intended to describe a feature of an example of the present disclosure, not to imply that every embodiment thereof must have the described feature. Moreover, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the figures, representations of directions such as up, down, left, right, front and rear, used for explaining the structure and movement of the various elements of the present disclosure, are not absolute, but relative. These representations are appropriate when the elements are in the position shown in the figures. If the description of the positions of the elements changes, however, these representations are to be changed accordingly.

Hereinafter, preferred embodiments of the present disclosure will be further described in detail in combination with figures.

Referring to FIG. 1 through FIG. 4, a cable connector 100 generally includes an electrical connector 10, a shielding shell 80 mounted on a rear end of the electrical connector 10, an insulating outer shell 30 covering an outer periphery of the shielding shell 80 and a cable 40 electrically connecting with the electrical connector 10 together. Herein, conductive wires of the cable 40 of the present preferred embodiment are directly soldered to the electrical connector 10, however, in other embodiments, the conductive wires of the cable also may establish an electrical connection with the electrical connector 10 via an intermediate circuit board (not shown). A connected joint between the cable 40 and the electrical connector 10 are covered by the shielding shell 80 and the insulating outer shell 30. The shielding shell 80 is preferably composed of a lower shell 801 and an upper shell 802 which are engaged with each other. A front end of the lower shell 801 and a front end of the upper shell 802 each are provided with two latching portions 804 protruding along an up-down direction so that each latching portion 804 of the lower shell 801 opposes one latching portion 804 of the lower shell 801.

The cable connector 100 may be correspondingly inserted into another mating connector 90. The mating connector 90 is an electrical connector receptacle soldered on a circuit board 300, and generally includes an insulating body 901, a plurality of conductive terminals 902 fixed to the insulating body 901, a shielding shell 903 enclosing the insulating body 901, an inner shielding shell 904 mounted outside the insulating body 901 and positioned inside the shielding shell 903 and a shielding member 905 embedded in the middle of the insulating body 901 for separating two groups of conductive terminals 902 from each other. Herein, two sides of the insulating body 901 in the front of the insulating body 901 each are formed with a latching groove 9011, two sides of the shielding member 905 are respectively exposed to the two latching grooves 9011. The shielding shell 903 is provided with a plurality of ground soldering legs 9031 which may correspondingly soldered to grounding lines on the circuit board 300.

FIG. 5 through FIG. 15 illustrate a first preferred embodiment of the electrical connector of the present disclosure, the electrical connector 10 generally includes an insulating housing 1, a first module 2 and a second module 3 which are mounted on a rear side of the insulating housing 1 and oppose each other along the up-down direction and are engaged together, two conductive latching members 4 respectively mounted on two sides of the insulating housing 1, a shielding piece 5 provided between the first module 2 and the second module 3 and electrically connecting with the two conductive latching members 4, two conductive elastic sheets 6 respectively mounted at an outer side of a top portion of the insulating housing 1 and an outer side of a bottom portion of the insulating housing 1, and an outer shielding shell 7 enclosing the two conductive elastic sheets 6, the two conductive latching members 4 and the insulating housing 1 therein.

Herein, the shielding piece 5 separates a group of conductive terminals 22 provided to the first module 2 from a group of conductive terminals 32 provided to the second module 3, and the shielding piece 5 can electrically connect with the shielding member 905 of the mating connector 90 together via an electrical connection with the two conductive latching members 4 so as to establish grounding paths, so crosstalk between the first conductive terminals 22 and the second conductive terminals 32 may be effectively reduced. In addition, the outer shielding shell 7 is preferably electrically connected with the two conductive elastic sheets 6 and the two conductive latching members 4, and thus has a plurality of grounding paths. When the cable connector 100 is correspondingly inserted into the mating connector 90, the two conductive elastic sheets 6 will electrically contact the inner shielding shell 904 of the mating connector 90, at the same time the two conductive elastic sheets 6 will also electrically connect with the outer shielding shell 7, so that the outer shielding shell 7 and the inner shielding shell 904 may be electrically connected together via the two conductive elastic sheets 6, and are further grounded via the grounding lines on the circuit board 300. The two conductive latching members 4 will latch on the two sides of the shielding member 905 of the mating connector 90 and establishes an electrical connection with the shielding member 905. It can be seen that, the outer shielding shell 7 of the electrical connector 10 may establish a grounding path via the inner shielding shell 904 and the shielding member 905 of the mating connector 90, which is beneficial to reduce noise and thus can promote signal transmitting quality during high speed data transmission.

The insulating housing 1 is integrally molded. The insulating housing 1 generally includes a bottom wall 11, a top wall 12 opposing the bottom wall 11, two side walls 13 connected between the bottom wall 11 and the top wall 12, two mounting columns 18 protruding outwardly from each of the bottom wall 11 and the top wall 12, two holding arms 15 protruding rearward from the two side walls 13 and two hooking portions 19 which are respectively provided to two inner sides of the two holding arms 15, oppose each other and protrude.

The bottom wall 11, the top wall 12 and the two side walls 13 of the insulating housing 1 encloses to form a mating cavity 16 opened a front end of the mating cavity 16. Herein, the bottom wall 11 is formed with a group of first terminal grooves 111 which penetrate the bottom wall 11, the top wall 12 is formed with a group of second terminal grooves 121 which penetrate the top wall 12, the two side walls 13 each are formed with one latching groove 14. The insulating housing 1 is formed with a receiving space 17 between a rear side of the mating cavity 16 and the two holding arms 15.

The first module 2 includes a first insulating member 21 and a group of first conductive terminals 22 embedded in and fixed to the first insulating member 21. Herein, each first conductive terminal 22 includes a fixed portion 221 embedded in the first insulating member 21, a contacting portion 222 extending forward from the fixed portion 221 and extending into the first terminal groove 111 and a tail portion 223 extending rearward from the fixed portion 221.

The first insulating member 21 generally includes a base portion 211 which is relatively wide and large, a protruding portion 212 extending forward from a front edge of the base portion 211 and a soldering protruding portion 213 extending rearward from a rear side of the base portion 211. The first insulating member 21 is formed with an accommodating groove 214 recessed on an engaging surface toward the second module 3. The first insulating member 21 is formed with a fixing groove 215 positioned at each of two sides of the protruding portion 212 and extending along a front-rear direction. The first insulating member 21 is formed with a positioning block 216 positioned at each of two sides of the base portion 211 and protruding outwardly, the positioning block 216 may engage with a latching structure of the shielding shell 80 for positioning. A bottom portion of the first insulating member 21 is formed with two latched grooves 217. The first insulating member 21 is further formed with a fixing portion 218 at the accommodating groove 214. The first insulating member 21 is further formed with a first hook engaging portion 219 at each of two sides of the protruding portion 212. Specifically, the protruding portion 212 has a front end surface 2122. The soldering protruding portion 213 includes a plurality of partitioning walls 2131 and a plurality of terminal receiving grooves 2132 formed among the partitioning walls 2131, the tail portions 223 of the first conductive terminals 22 are correspondingly received in the terminal receiving grooves 2132 by one to one, in which an interval between the two adjacent tail portions 223 is larger than an interval between the two adjacent contacting portions 222, thereby facilitating soldering wire operation. The accommodating groove 214 includes a first part 2141 positioned in the middle and two second parts 2142 respectively positioned at two sides of the first part 2141. Herein, a groove depth of the first part 2141 is shallower than a groove depth of the second part 2142. The two fixing grooves 215 are respectively provided at two sides of the accommodating groove 214. The fixing portion 218 specifically includes a positioning column 2181 protruding at the first part 2141 of the accommodating groove 214 and a positioning groove 2182 recessed at the first part 2141 of the accommodating groove 214. The two first hook engaging portions 219 obliquely extend rearward and outwardly respectively from the two sides of the protruding portion 212.

Referring to FIG. 12 through FIG. 15, the second module 3 has the same shape and structure as the first module 2. The second module 3 includes a second insulating member 31 and a group of second conductive terminals 32 embedded in and fixed to the second insulating member 31. Herein, each second conductive terminal 32 includes a fixed portion 321 embedded in the second insulating member 31, a contacting portion 322 extending forward from the fixed portion 321 and extending into the second terminal groove 121 and a tail portion 323 extending rearward from the fixed portion 321.

The second insulating member 31 generally includes a base portion 311, a protruding portion 312 extending forward from the base portion 311 and a soldering protruding portion 313 extending rearward from the base portion 311. The second insulating member 31 is formed with an accommodating groove 314 recessed on an engaging surface toward the first module 2. The second insulating member 31 is provided with a fixing groove 315 at each of two sides of the protruding portion 312. Two sides of the second insulating member 31 each are provided with a positioning block 316. A top portion of the second insulating member 31 is provided with two latched grooves 317. The second insulating member 31 is further provided with a fixing portion 318 at the accommodating groove 314. The second insulating member 31 is further formed with a second hook engaging portion 319 at each of the two sides of the protruding portion 312. Specifically, the protruding portion 312 has a front end surface 3122, herein the front end surface 2122 of the first insulating member 21 and the front end surface 3122 of the second insulating member 31 correspondingly close a rear end of the mating cavity 16. The soldering protruding portion 313 includes a plurality of partitioning walls 3131 and a plurality of terminal receiving grooves 3132 formed among the partitioning walls 3131, the tail portions 323 of the second conductive terminals 32 are correspondingly received in the terminal receiving grooves 3132 by one to one, herein an interval between two adjacent tail portions 323 is more than an interval between two adjacent contacting portions 322, thereby facilitating soldering wire operation. The accommodating groove 314 includes a first part 3141 positioned in the middle and two second parts 3142 respectively positioned at two sides of the first part 314. Herein a groove depth of the first part 3141 is shallower than a groove depth of the second part 3142. The fixing portion 318 includes a positioning column 3181 protruding at the first part 3141 of the accommodating groove 314 and a positioning groove 3182 recessed at the first part 3141 of the accommodating groove 314.

In the present embodiment, the two holding arms 15 of the insulating housing 1 correspondingly clamp two sides of the first insulating member 21 and second insulating member 31, the use of the holding arms 15 may attain to have elastic clamping effect. A combination of the first module 2, the second module 3 and the shielding piece 5 is fixed to the rear side of the insulating housing 1 by that the two first hook engaging portions 219 of the first module 2 and the two second hook engaging portions 319 of the second module 3 correspondingly hook and engage with the two hooking portions 19 on the two holding arms 15 of the insulating housing 1. Specifically, the second module 3 and the first module 2 oppose each other along the up-down direction and are engaged together, and are correspondingly mounted on the rear side of the insulating housing 1. More specifically, the protruding portion 212 of the first insulating member 21 and the protruding portion 312 of the second insulating member 31 are stacked together and correspondingly fixed and received in the receiving space 17 of the insulating housing 1.

In combination with referring to FIG. 5 through FIG. 11, in the present embodiment, the mating cavity 16 is symmetric about 180 degrees rotation, which thus may support the mating connector 90 to be inserted into the electrical connector 10 in two directions, the contacting portions 222 of the group of first conductive terminals 22 and the contacting portions 322 of the group of second conductive terminals 32 are also symmetric about 180 degrees rotation, which thus may support insertion in two direction. The second module 3 and the first module 2 are preferably same, which may use the same mold to manufacture the first module 2 and the second module 3; and when the first module 2 and the second module 3 are combined together, it doe not need to distinguish the first module 2 and the second module 3, it only needs to simply make the first module 2 and the second module 3 oppose each other along the up-down direction and engaged together, which simplifies the manufacturing process of the electrical connector 10 and save mold cost.

Figure 14:
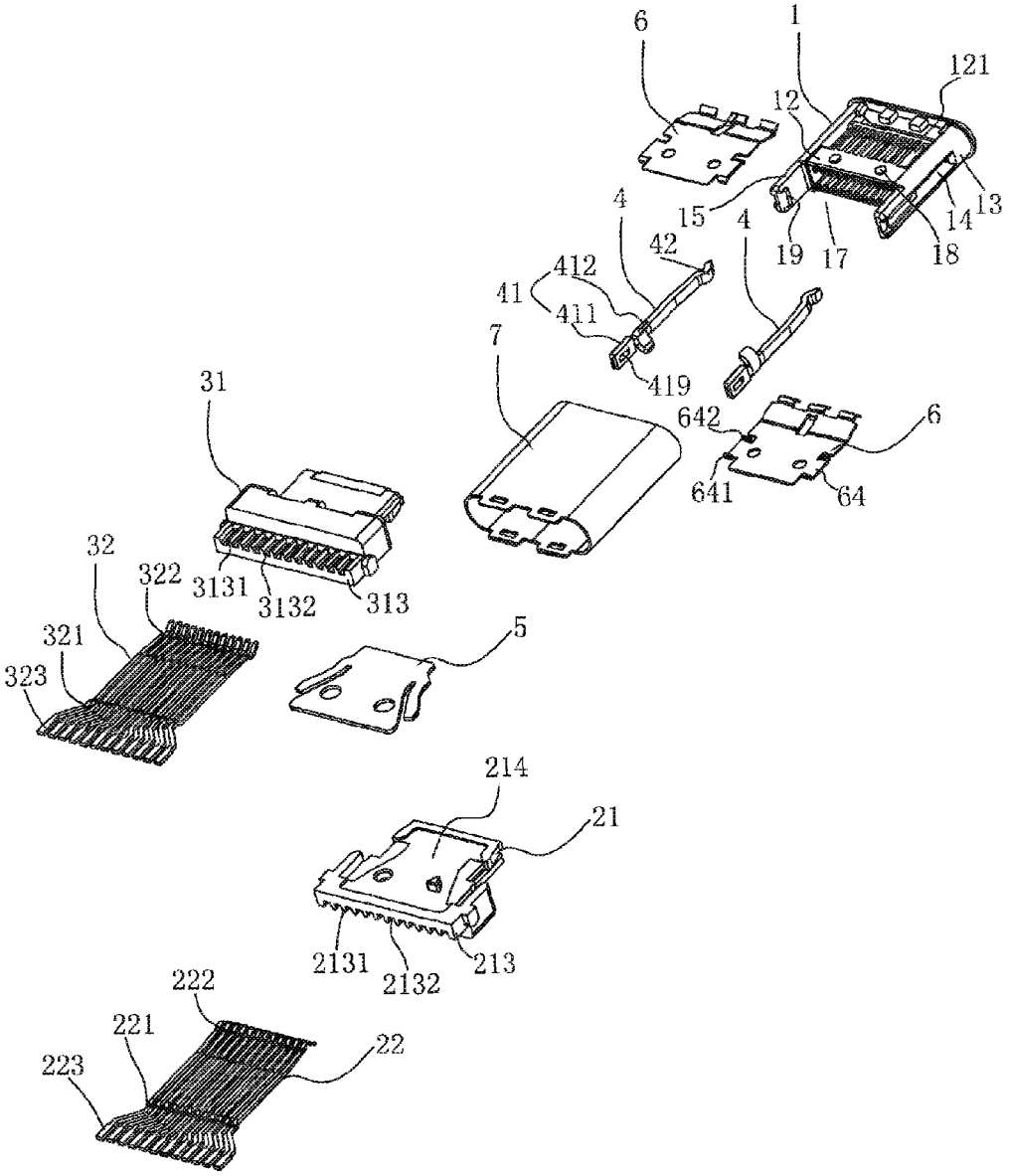
FIG. 14 is a further exploded perspective view of the electrical connector as shown in FIG. 13.
Figure 15:
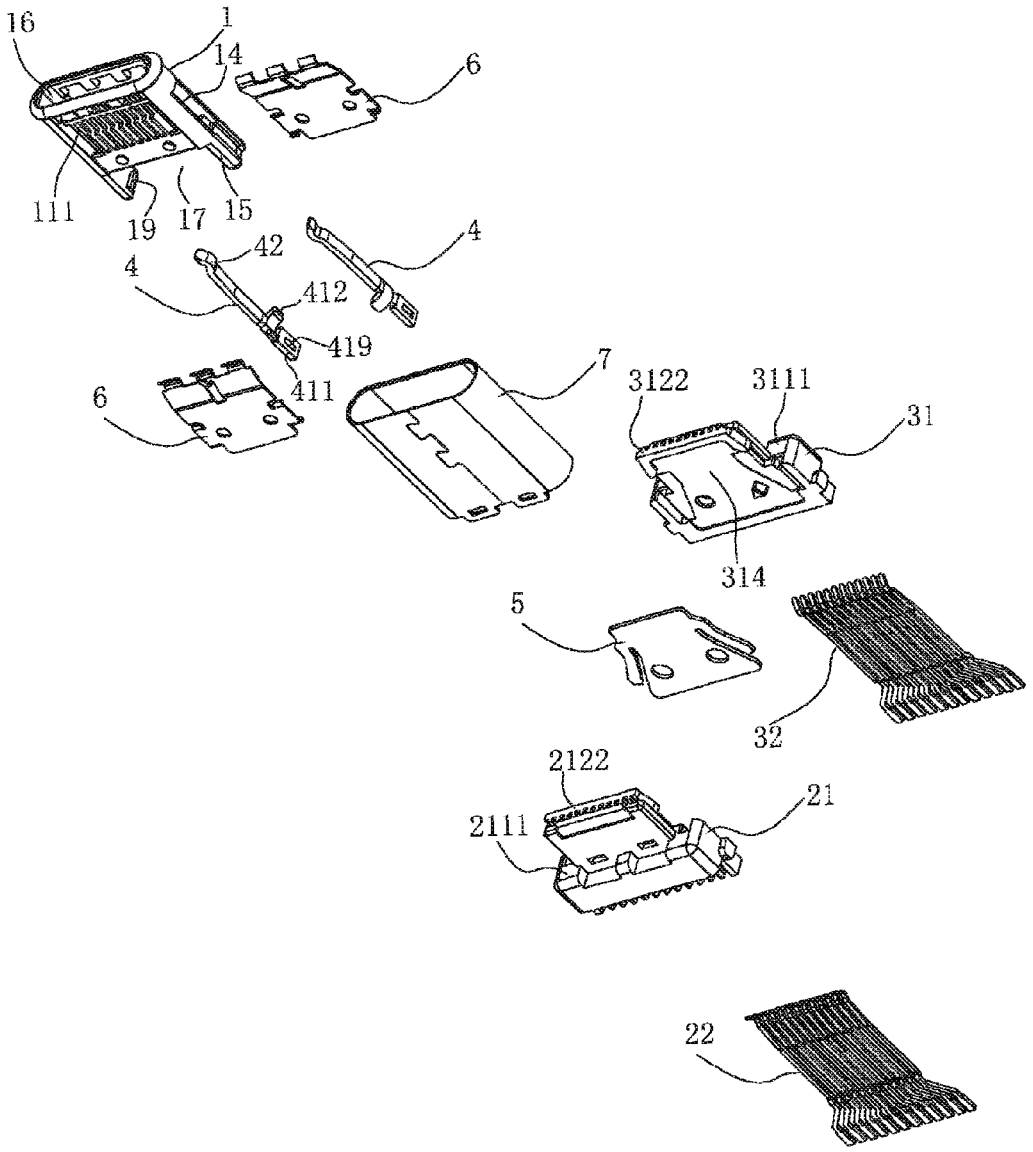
FIG. 15 is a perspective view of the electrical connector as shown in FIG. 14 from another angle.
Figure 16:
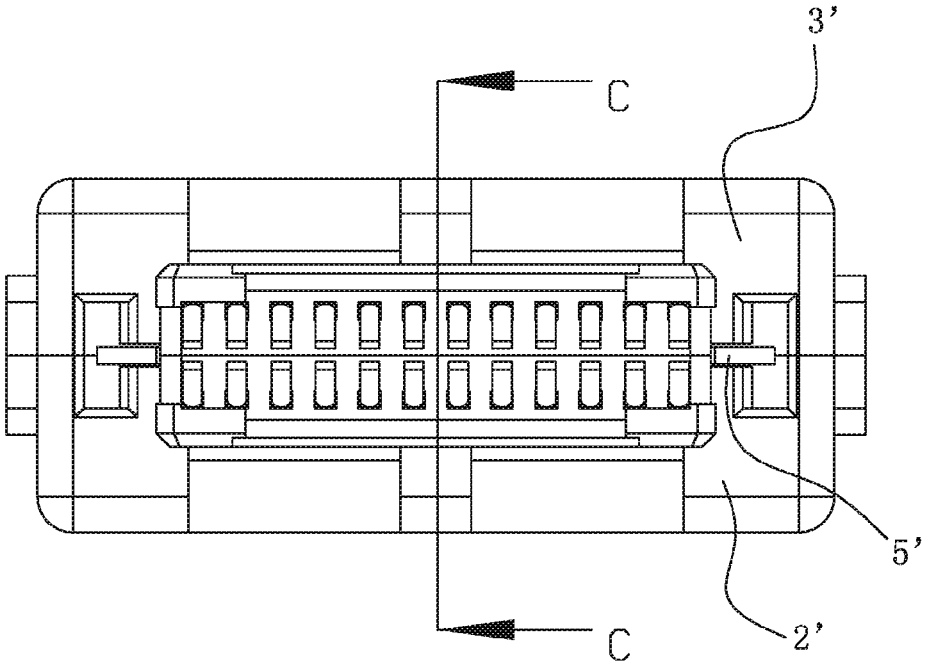
FIG. 16 is a front view of a first module and a second module of a second embodiment of the electrical connector of the present disclosure.
Figure 17:
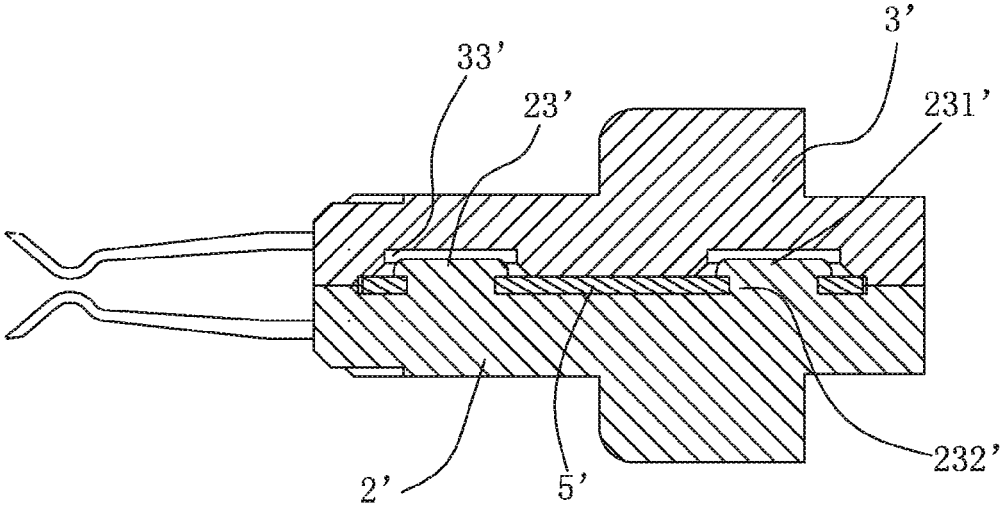
FIG. 17 is a cross sectional view taken along a line C-C of FIG. 16.
Figure 18:
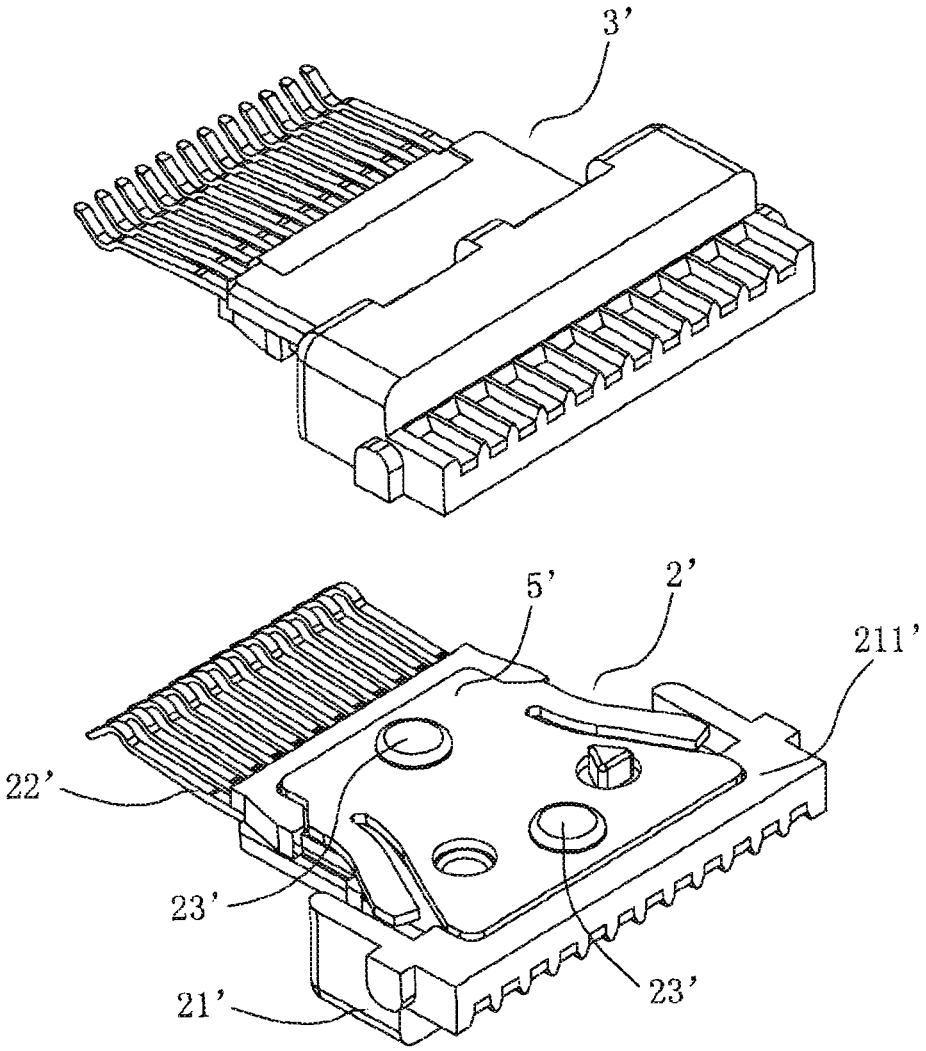
FIG. 18 is an exploded perspective view of the first module and the second module as shown in FIG. 16.
Figure 19:
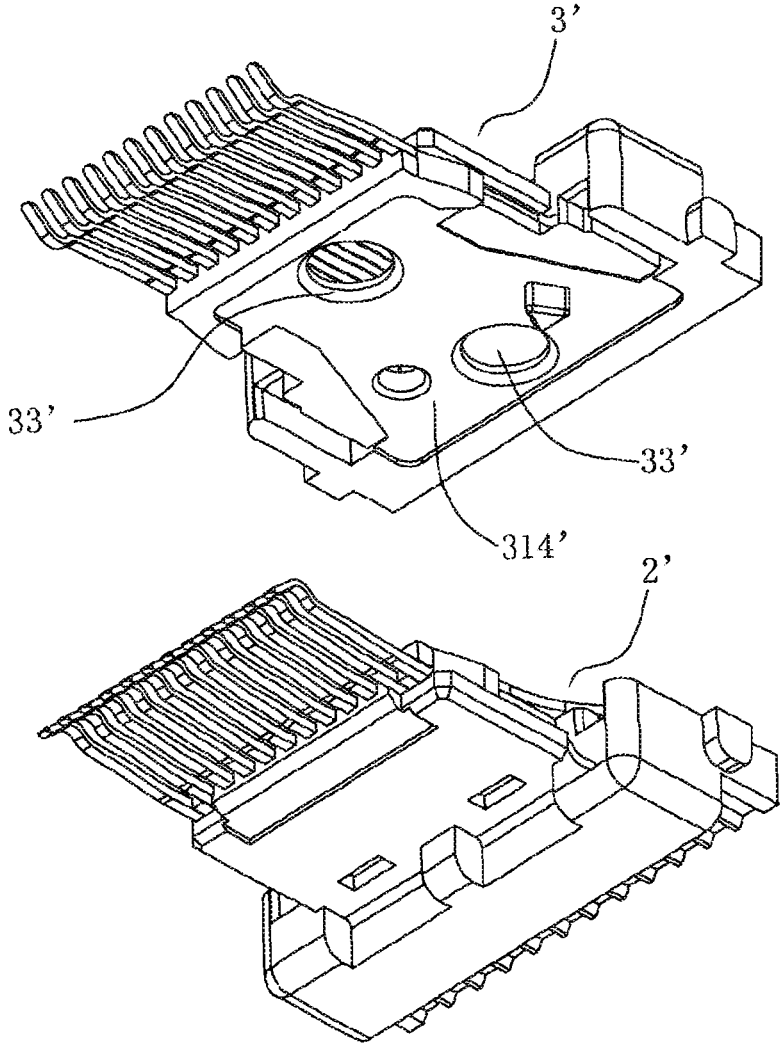
FIG. 19 is a perspective view of the first module and the second module as shown in FIG. 18 from another angle.
Figure 20:
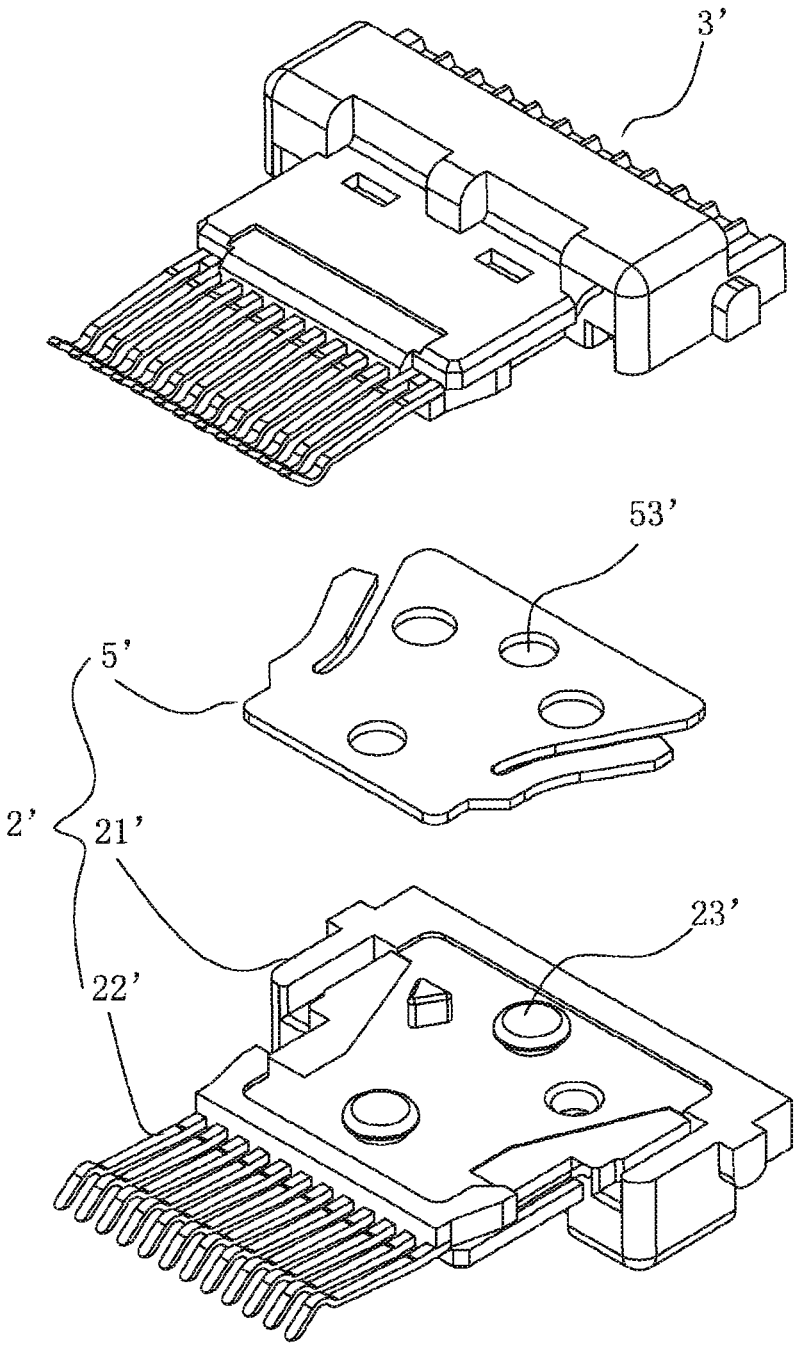
FIG. 20 is a further exploded perspective view of the first module and the second module as shown in FIG. 18.

Referring to FIG. 14 and FIG. 15, the conductive latching member 4 is integrally formed by punching and bending a conductive metal material. Specifically, in the present embodiment, the conductive latching member 4 is provided as two in number, each conductive latching member 4 includes a fixating portion 41 and an elastic latching portion 42 extending forward from the fixating portion 41 and extending into the mating cavity 16 via the latching groove 14. Specifically, the fixating portion 41 includes a latching arm 411 extending rearward and two positioning arms 412 bending from a front end of the latching arm 411 respectively toward an upper side and a lower side and extending. The latching arm 411 is opened with a latched hole 419. However, in some alternative embodiments, the two conductive latching members 4 of the present embodiment also may be connected by a connecting arm (not shown) which is transversally connected to two rear ends of the two latching arms 411 to form a conductive latching member which has a U-shape as whole.

Referring to FIG. 8 through FIG. 13, the two conductive latching members 4 are respectively mounted at two outer sides of the two side walls 13 of the insulating housing 1. The latching arm 411 is correspondingly inserted into between the fixing groove 215 of the first insulating member 2 and the fixing groove 315 of the second insulating member 3. The positioning arm 412 is correspondingly clamped between the rear end of the insulating housing 1 and a front surface 2111 of the base portion 211 of the first insulating member 2 and a front surface 3111 of the base portion 311 of the second insulating member 3, so that the two conductive latching members 4 may be positioned and prevented from moving along the front-rear direction. When the electrical connector 10 is mated with the mating connector 90, the two elastic latching portions 42 of the two conductive latching members 4 will respectively latch on the two sides of the shielding member 905 of the mating connector 90, electrically connect with the shielding member 905 so as to establish a grounding path. And, at this time, the two elastic latching portions 42 of the two conductive latching members 4 preferably abut an inner wall of the outer shielding shell 7, which can provide a relative large latching force, at the same time can also provide a grounding path for the outer shielding shell 7 by contacting the outer shielding shell 7.

Referring to FIG. 8, FIG. 12 through FIG. 15, the shielding piece 5 is integrally formed by punching a conductive metal sheet. The shielding piece 5 includes a plate body 51 and two grounding portions 52 respectively extending from two sides of the plate body 51. The middle of the plate body 51 is provided with two through holes 518. Herein, an appearance of the shielding piece 5 looks like a coat, the plate body 51 may be further divided into a main body portion 511 and two shoulder portions 512 positioned at two sides of a top end of the main body portion 511. The two grounding portions 52 are shaped as two sleeves respectively extending from the two shoulder portions 512. A movement gap 53 is provided between each of the two grounding portions 52 and the plate body 51, so that the two grounding portions 52 each may be configured as in form of an elastic arm which can be elastically deformed horizontally and outwardly or horizontally and inwardly.

Figure 7:
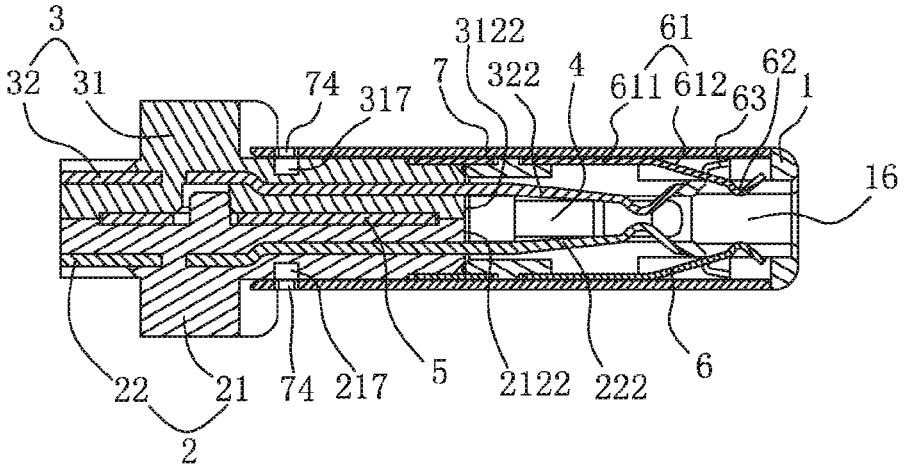
FIG. 7 is a cross sectional view taken along a line A-A of FIG. 6.
Figure 8:
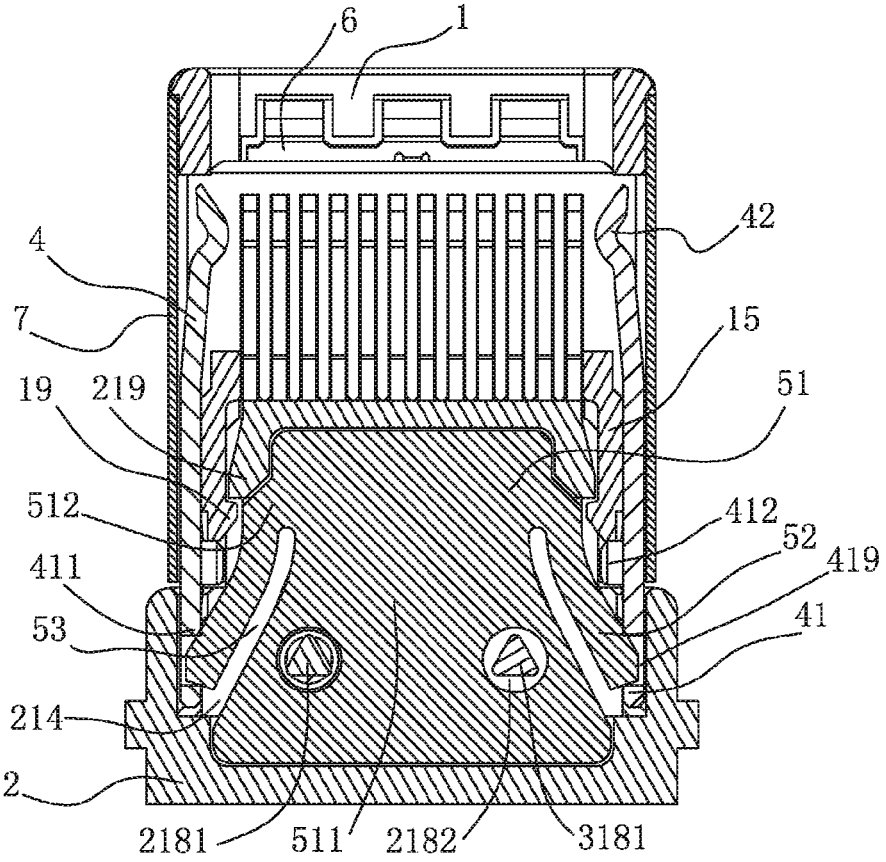
FIG. 8 is a cross sectional view taken along a line B-B of FIG. 6.
Figure 9:
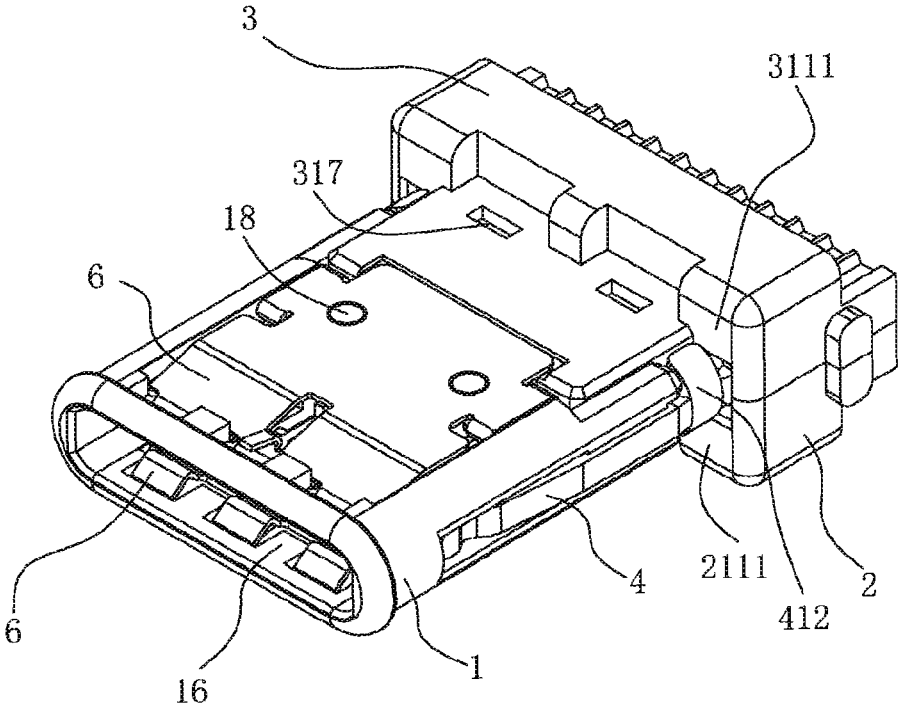
FIG. 9 is a perspective view of the electrical connector as shown in FIG. 5 with an outer shielding shell removed.
Figure 10:
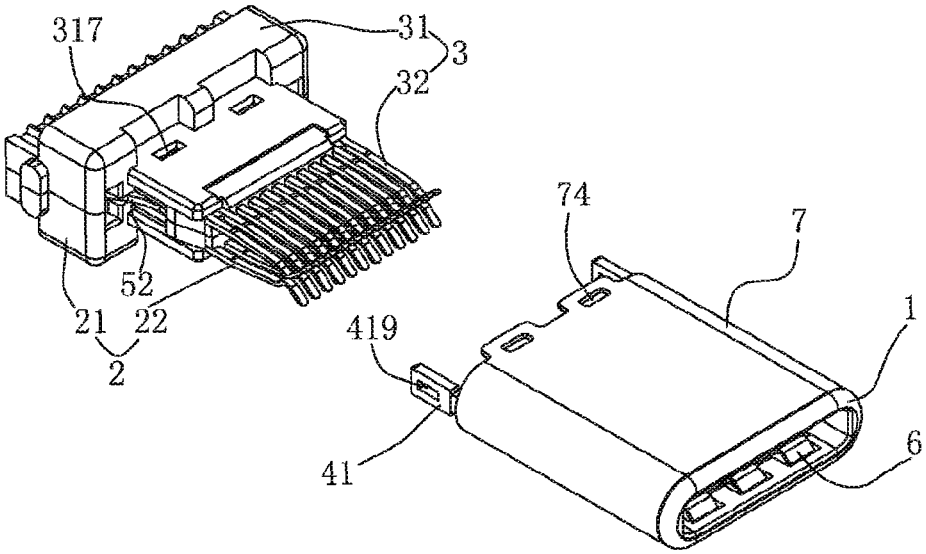
FIG. 10 is an exploded perspective view of the electrical connector as shown in FIG. 5.
Figure 11:
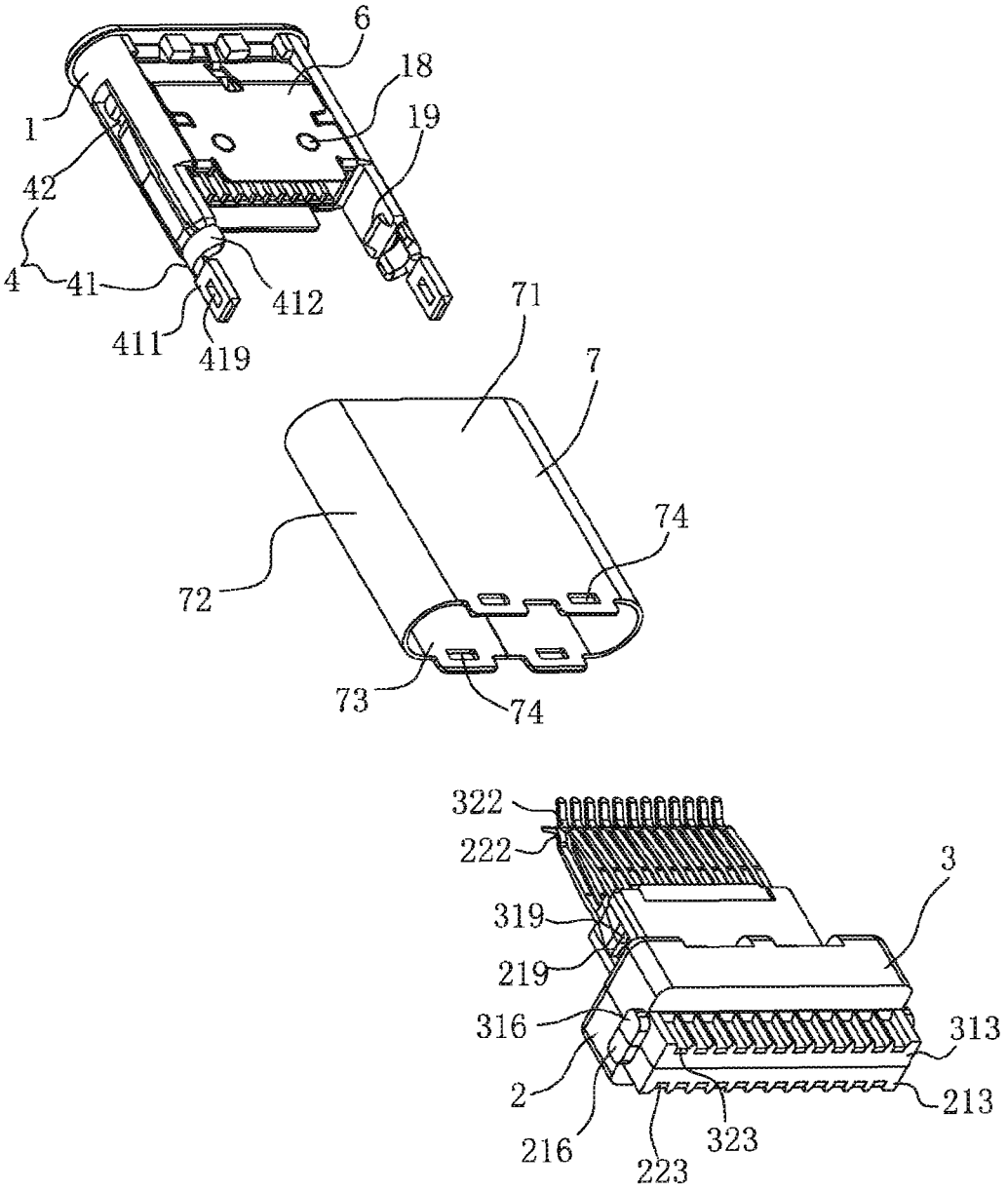
FIG. 11 is a further exploded perspective view of the electrical connector as shown in FIG. 10.

Referring to FIG. 7, FIG. 8 and FIG. 10, the shielding piece 5 is mounted between the first module 2 and the second module 3. The shielding piece 5 separates the fixed portions 221 of the first conductive terminals 22 and the fixed portions 321 of the second conductive terminals 32.

The plate body 51 is correspondingly clamped between the first part 2141 of the accommodating groove 214 of the first insulating member 21 and the first part 3141 of the accommodating groove 314 of the second insulating member 31; and the two grounding portions 52 each are accommodated between the second part 2142 of the accommodating groove 214 and the second part 3142 of the accommodating groove 314 and may be elastically displaced. Two grounding portions 52 obliquely extend rearward and transversally outwardly from the two sides of the plate body 51, respectively. A distal end of the grounding portion 52 correspondingly latches in the latched hole 419 of the conductive latching member 4. With such an engagement structure between the grounding portion 52 and the latched hole 419, the two conductive latching members 4 may be securely fixed to the two sides of the insulating housing 1, and the shielding piece 5 tightly contacts the two conductive latching members 4. When the electrical connector 10 is mated with the mating connector 90, the shielding piece 5 can electrically connects with the shielding member 905 of the mating connector 90 via the two elastic latching portions 42 of the two conductive latching members 4, so as to make the shielding piece 5 electrically grounded and to shield crosstalk between the first conductive terminals 22 and the second conductive terminals 32.

The two through holes 518 of the plate body 51 respectively correspond to the fixing portion 218 of the first insulating member 21 and the fixing portion 318 of the second insulating member 31 in position, so that the positioning column 2181 of the first insulating member 21 may pass through one through hole 518 to engage with the positioning groove 3182 of the second insulating member 31, at the same time the positioning column 3181 of the second insulating member 31 may pass through the other through hole 518 to engage with the positioning groove 2182 of the first insulating member 21.

It should be noted that, because the groove depth of the first part 2141 of the accommodating groove 214 of the first module 2 is shallower than the groove depth of the second part 2142, and the groove depth of the first part 3141 of the accommodating groove 314 of the second module 3 is also shallower than the groove depth of the second part 3142. Therefore, when the shielding piece 5 is clamped between the first module 2 and the second module 3, the plate body 51 of the shielding piece 5 will be clamped tightly, at the same time there is a gap between each of the two grounding portions 52 of the shielding piece 5 the second parts 2142, 3142 so as to allow the two grounding portions 52 to elastically displaced horizontally transversally outwardly or horizontally transversally inwardly, so as to facilitate the distal end of each grounding portion 52 is first transversally inwardly displaced when the distal end of each grounding portion 52 initially contacts the latching arm 411 of the corresponding conductive latching member 4, until the latching arm 411 is inserted rearward in place, the distal end of each grounding portion 52 will transversally outwardly rebound and insert into the latched hole 419, so that the two conductive latching members 4 cannot be detached forward.

Figure 13:
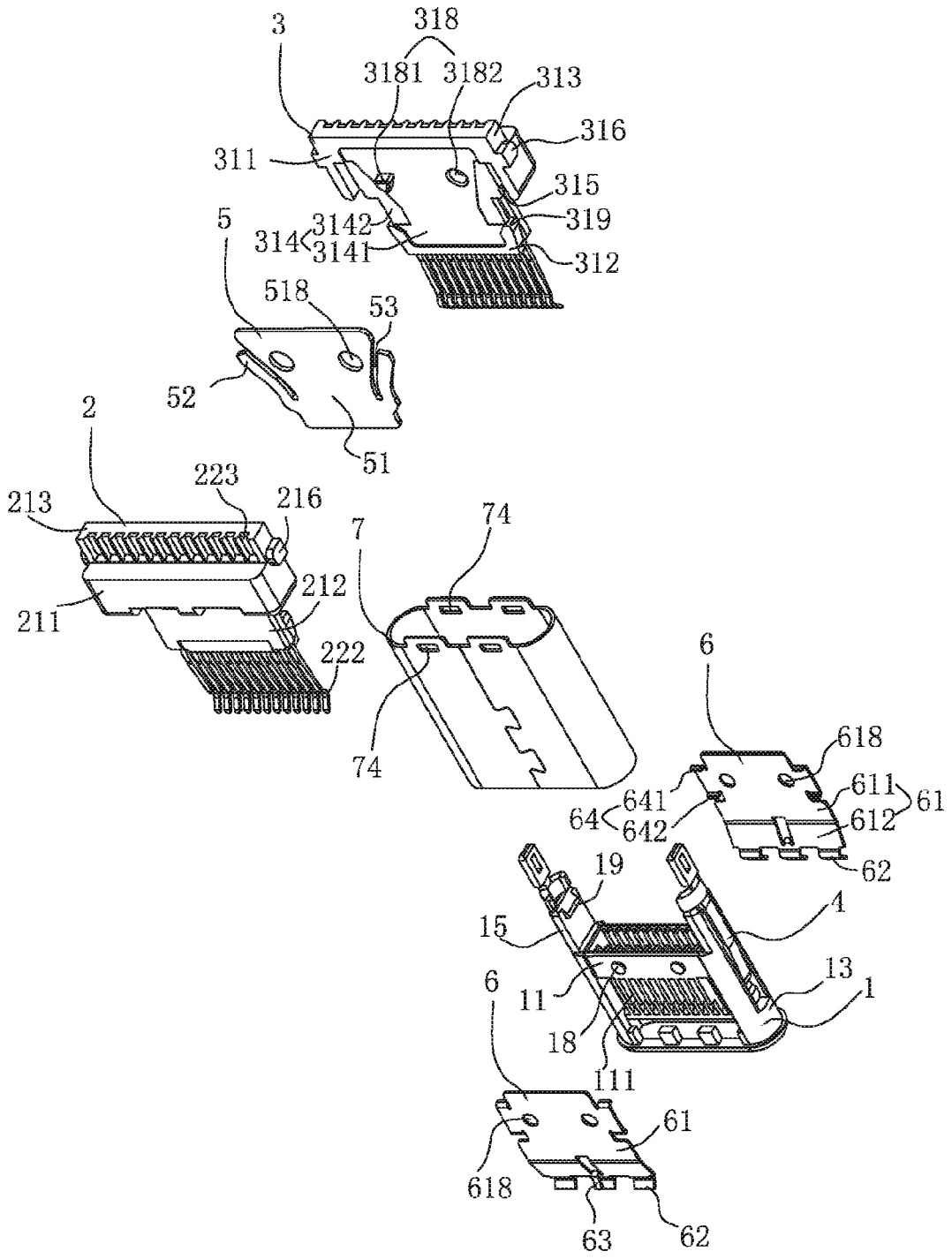
FIG. 13 is a further exploded perspective view of the electrical connector as shown in FIG. 12.

Referring to FIG. 13 through FIG. 15, the conductive elastic sheet 6 is integrally formed by punching and bending a conductive metal material. In the present embodiment, the conductive elastic sheet 6 is provided as two in number, each conductive elastic sheet 6 includes a body 61, a first contact portion 62 and a second contact portion 63 bending from the body 61 and extending and two positioning portions 64 respectively formed at the two sides of the body 61.

In combination with referring to FIG. 7, the body 61 includes a first section 611 which is flat and a second section 612 obliquely extending from a front edge of the first section 611 toward the mating cavity 16. The first contact portion 62 bends from the second section 612 of the body 61 and extends toward the inside of the mating cavity 16. The second contact portion 63 bends from the second section 612 of the body 61 and extends toward the outer shielding shell 7. Specifically, in the present embodiment, the first contact portion 62 is composed of three elastic contact arms bending and extending inwardly, and the second contact portion 63 is one elastic contact arm bending and extending outwardly. Each positioning portion 64 includes two latching claws 641, 642 bending downward from a side surface of the body 61 and extending downward. The two latching claws 641, 642 oppose each other, can correspondingly grasp the bottom wall 11/the top wall 12 of the insulating body 1 so as to prevent the conductive elastic sheet 6 from being latched onto the insulating body 1.

Figure 12:
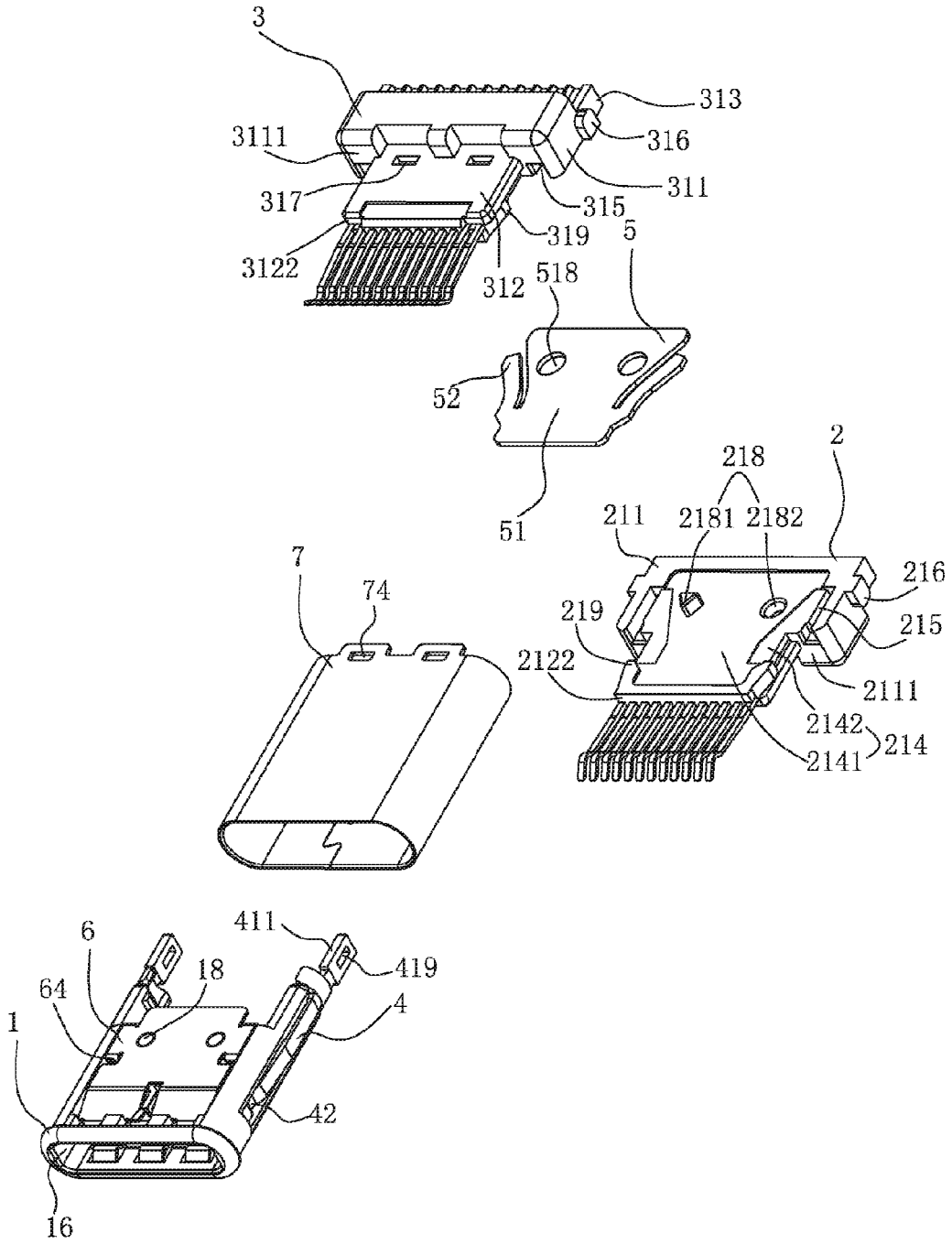
FIG. 12 is a further exploded perspective view of the electrical connector as shown in FIG. 11.

Referring to FIG. 12, FIG. 13 and FIG. 14, the middle of the first section 611 of the body 61 of the conductive elastic sheet 6 is formed with two mounting holes 618, the two mounting holes 618 corresponds to the two mounting columns 18 at an outer side of the insulating housing 1, so that one conductive elastic sheet 6 may be correspondingly mounted on an outer side of the bottom portion of the insulating housing 1, and the other conductive elastic sheet 6 may be correspondingly mounted an outer side of the top portion of the insulating housing 1. When the electrical connector 10 is mated with the mating connector 90, the first contact portions 62 of the two conductive elastic sheets 6 will contact the inner shielding shell 904 of the mating connector 90, so as to provide grounding for the two conductive elastic sheets 6; at the same time, the second section 612 of the conductive elastic sheet 6 is pushed outwardly to allow the second contact portion 63 to contact the outer shielding shell 7, so that the outer shielding shell 7 may electrically connect with the inner shielding shell 904 of the mating connector 90 via the conductive elastic sheet 6, which may provide another grounding path for the outer shielding shell 7; and, abutment between the second contact portion 63 and the outer shielding shell 7 may generate a counteracting force, so as to allow the contact between the conductive elastic sheet 6 and the inner shielding shell 904 of the mating connector 90 to be tight. It should be noted that, the first section 611 of the conductive elastic sheet 6 is attached on an inner side of the outer shielding shell 7 (see FIG. 7), in some embodiments, the conductive elastic sheet 6 may contact the outer shielding shell 7 by means of the first section 611 of the body 61, so that the second contact portion 63 is omitted (not shown). In addition, the electrical connector 10 may add an insulating membrane (not shown) on a side of each conductive elastic sheet 6 where each conductive elastic sheet 6 is attached on the insulating housing 1, so as to prevent each conductive elastic sheet 6 from contacting the first conductive terminal 22/the second conductive terminal 32 and prevent occurrence of unnecessary short circuit. In addition, although the conductive elastic sheet 6 in the present embodiment is specifically provided as separate two, however, in some alternative embodiments, two sides of the two conductive elastic sheets also may be connected together, so as to take one integral annular shape (not shown) enclosing the outer side of the insulating housing 1.

Referring to FIG. 11 through FIG. 15, the outer shielding shell 7 is integrally formed by punching and bending a conductive metal material. The outer shielding shell 7 includes a top wall 71, two side walls 72 bending downward respectively from two sides of the top wall 71 and extending and a bottom wall 73 formed by two parts which further extend from two bottom sides of the two side walls 72, oppose each other and are connected together. A rear end of the top wall 71 of the outer shielding shell 7 and a rear end of the bottom wall 73 of the outer shielding shell 7 each are formed with two latching holes 74. In combination with referring to FIG. 7, the two latching holes 74 of the bottom wall 73 oppose the two latched grooves 217 of the first insulating member 21 along the up-down direction. The two latching holes 74 of the top wall 71 oppose the two latched grooves 317 of the second insulating member 31 along the up-down direction. In combination with referring to FIG. 4, when the electrical connector 10 and the shielding shell 80 are engaged together, the two latching portions 804 on the front end of the lower shell 801 correspondingly upward pass through the two latching holes 74 on a bottom portion of the outer shielding shell 7 and insert into the two latched grooves 217 of the first insulating member 21, the two latching portions 804 on the front end of the upper shell 802 corresponding downward pass through the two latching holes 74 on a top portion of the outer shielding shell 7 and insert the two latched grooves 317 of the second insulating member 31. Such a latching structure may realize secure positioning between the electrical connector 10 and the shielding shell 80, and may enhance relative positioning among the first insulating member 21, the second insulating member 31 and the outer shielding shell 7.

The outer shielding shell 7 may enclose an outer periphery of the two conductive latching members 4 and two conductive elastic sheets 6 and electrically connect with the two conductive latching members 4 and two conductive elastic sheets 6. Specifically, the positioning arm 412 of the conductive latching member 4 may contact the inner wall of the outer shielding shell 7 in normal state so that the conductive latching member 4 and the outer shielding shell 7 are electrically connected together, in addition, when the electrical connector 10 and the mating connector 90 are inserted together, the elastic latching portion 42 of the conductive latching member 4 will contact an inner side of the side wall 72 of the outer shielding shell 7 so that the conductive latching member 4 and the outer shielding shell 7 are electrically connected together; when the electrical connector 10 and the mating connector 90 are inserted together, the second contact portion 63 of the conductive elastic sheet 6 will contact an inner side of the top wall 71/the bottom wall 73 of the outer shielding shell 7 so that the conductive elastic sheet 6 and the outer shielding shell 7 are electrically connected together. It can be seen that, with such a matched structure among the conductive latching member 4, the conductive elastic sheet 6 and the outer shielding shell 7, the outer shielding shell 7 has a plurality of grounding paths, so signal transmitting quality can be promoted during high speed data transmission; on the other hand, except that the rear end is provided with the latching holes 74 which are small, the outer shielding shell 7 does not have any other opening, the structure of the outer shielding shell 7 is quite complete, which is also beneficial to prevent electromagnetic radiation leakage.

An assembling process of the electrical connector 10 of the present disclosure generally includes forming the first conductive terminals 22, the second conductive terminals 32, the two conductive latching members 4, the shielding piece 5, the two conductive elastic sheets 6 and the outer shielding shell 7 by punching and bending; forming the insulating housing 1 by molding; then, injecting a molten plastic around an outer periphery of the first conductive terminals 22 by insert molding process to form the first insulating member 21, and injecting a molten plastic around an outer periphery of the second conductive terminals 32 to form the second insulating member 31, so as to obtain the first module 2 and the second module 3; next stacking the first module 2, the shielding piece 5 and the second module 3 to form a first combination; then inserting the two conductive latching members 4 onto the first combination from the front to the rear; next mounting the two conductive elastic sheets 6 onto an outer periphery of the insulating housing 1, then inserting the insulating housing 1 into the outer shielding shell 7 from the front to the rear so as to obtain a second combination; finally, inserting the first combination into the second combination from the rear to the front, until the two latching portions 19 of the insulating housing 1, the two first hook engaging portions 219 of the first insulating member 21 and the two second hook engaging portions 319 of the second insulating member 31 are correspondingly latched together, so that the first combination and the second combination are securely engaged together.

When the electrical connector 10 and the mating connector 90 of the present disclosure are inserted together, a plurality of shielding layers may be formed in structure. Specifically: 1. an intermediate shielding layer: is composed of the shielding piece 5 and the two conductive latching members 4 of the shielding member 905 and the shielding member 905 of the mating connector 90, may separate the group of conductive terminals 22 of the electrical connector 10 and one group of conductive terminals 902 of the mating connector 90 from the group of conductive terminals 32 of the electrical connector 10 and the other group of conductive terminals 902 of the mating connector 90 along the up-down direction, prevent crosstalk between these conductive terminals; 2. an inner shielding layer: is composed of the two conductive elastic sheets 6 of the electrical connector 10 and the inner shielding shell 904 of the mating connector 90, may enclose the contacting portions 222, 322 of the two groups of conductive terminals 22, 32 of the electrical connector 10 and corresponding contacting portions of the two groups of conductive terminals 902 of the mating connector 90 in a position relatively close to these terminals, further prevents crosstalk among these conductive terminals; 3. an outer shielding layer: is composed of the outer shielding shell 7 of the electrical connector 10 and the shielding shell 903 of the mating connector 90, may enclose the contacting portions 222, 322 of the two groups of conductive terminals 22, 32 of the electrical connector 10 and the corresponding contacting portions of the two groups of conductive terminals 902 of the mating connector 90 in a position relatively far from these terminals, prevent these conductive terminals from emitting electromagnetic radiation toward surrounding circumstance/absorbing electromagnetic radiation from surrounding circumstance. In addition, the different shielding layers in structure may also have a plurality of grounding paths, for example: the outer shielding layer may be grounded via the ground soldering leg 9031 of the shielding shell 903; the inner shielding layer may be grounded via the outer shielding layer by the electrical connection between the conductive elastic sheet 6 and the outer shielding shell 7; the intermediate shielding layer may be grounded via the outer shielding layer by the electrical connection between the conductive latching member 4 and the outer shielding shell 7; in addition, the intermediate shielding layer may be further grounded by connecting a ground soldering leg (not shown), which directly extends from the shielding member 905, to the circuit board 300; moreover, the intermediate shielding layer may be further grounded via the outer shielding layer by an electrical connection between the shielding member 905 and the shielding shell 903.

In comparison with the prior art, in the electrical connector 10 of the present disclosure, a shielding piece 5 is provided between the first conductive terminals 22 and the second conductive terminals 32, and the shielding piece 5 is grounded via the conductive latching member 4, crosstalk between the first conductive terminals 22 and the second conductive terminals 32 may effectively shielded; in addition, the conductive elastic sheet 6 is provided, the outer shielding shell 7 can be grounded by that the conductive elastic sheet 6 contacts the inner shielding shell 904 of the mating connector 90, more grounding paths may be provided, so that signal transmitting quality can be promoted during high speed data transmission, and it is beneficial to maintain completeness of the outer shielding shell 7 so as to prevent electromagnetic radiation leakage.

FIG. 16 through FIG. 20 illustrate a second embodiment of the electrical connector of the present disclosure, the electrical connector is similar to the previous electrical connector 10, a difference mainly lies in that: a first combination (that is a combination of a first module 2', a second module 3' and a shielding piece 5') of the electrical connector is different from the first combination (that is a combination of the first module 2, the second module 3 and the shielding piece 5) of the electrical connector 10 in structure. Specifically, in the present embodiment, the shielding piece 5' and the first module 2' are integrally engaged by insert molding process, but do not like the first embodiment in which the shielding piece 5 is clamped between the first module 2 and the second module 3. Specifically, the shielding piece 5' is formed with two engaging holes 53'. The first insulating member 21' is formed with two engaging portions 23' corresponding to the two engaging holes 53'. The second insulating member 31' is formed with two avoidance grooves 33' corresponding to the two engaging portions 23' and positioned at the accommodating groove 314'. In the present embodiment, the two engaging portions 23' are protruding columns, and a distal end part 231' of each protruding column 23' is larger than a part 232' of each protruding column 23' positioned in the engaging hole 53', which may effectively prevent the shielding piece 5' from being detached. A top surface of the shielding piece 5' is higher than a top surface of the base portion 211'. In the present embodiment, that the shielding piece 5' is integrally fixed to the first module 2' may reduce assembling steps of the electrical connector.

Figure 21:
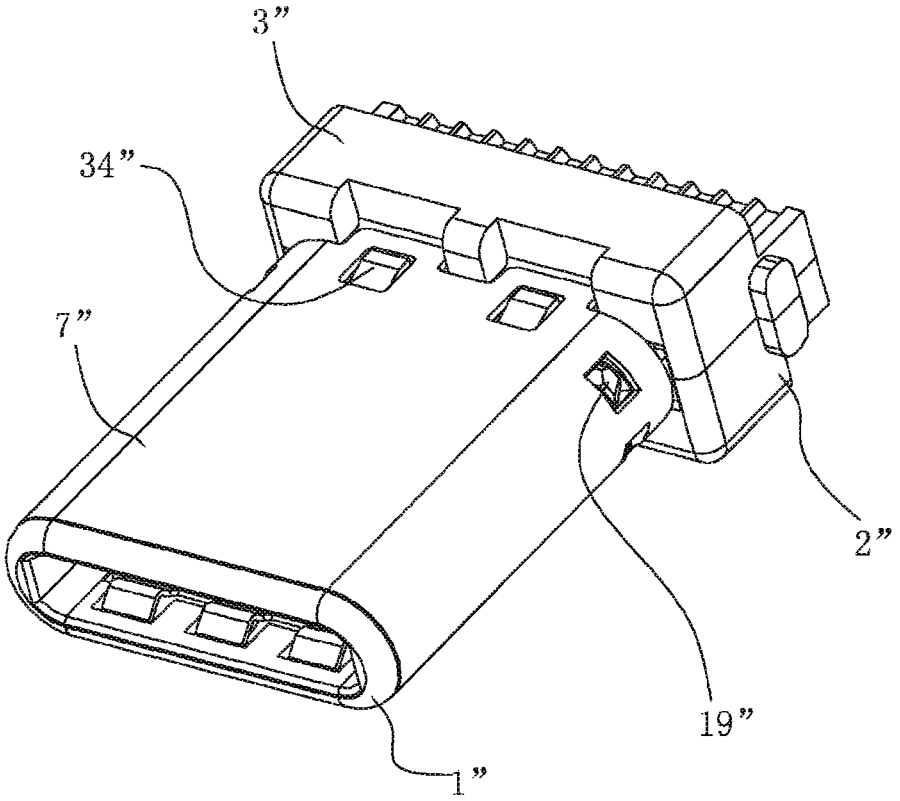
FIG. 21 is a perspective view of a third embodiment of the electrical connector of the present disclosure.
Figure 22:
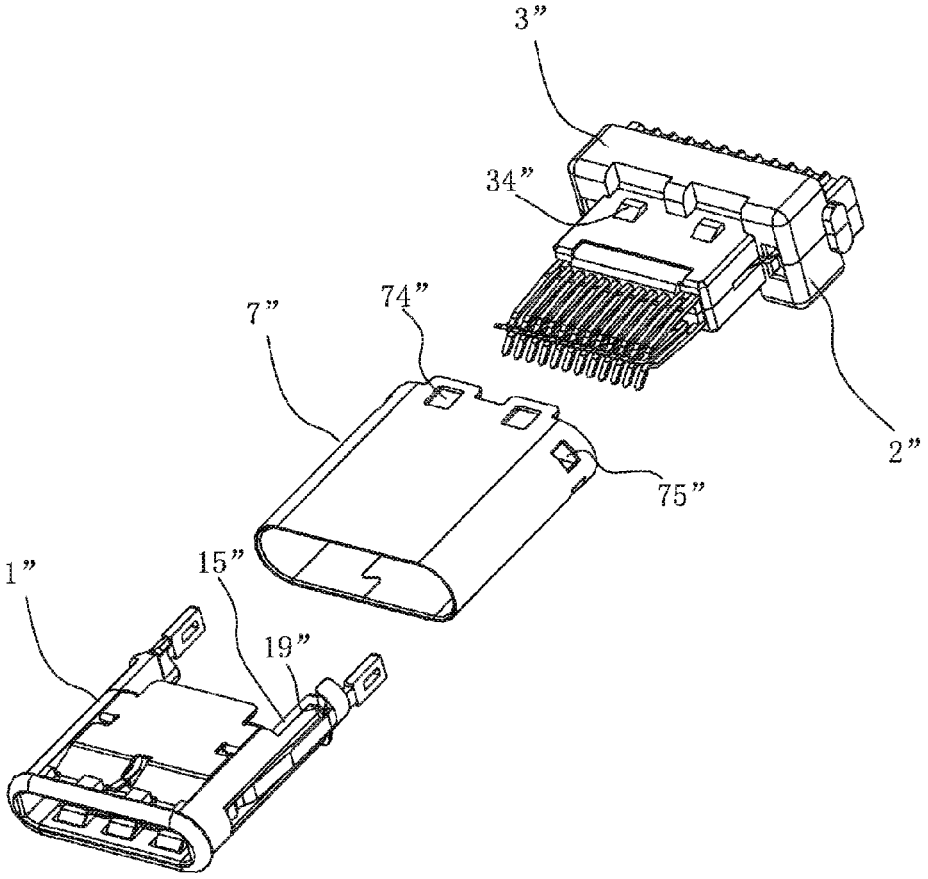
FIG. 22 is an exploded perspective view of the electrical connector as shown in FIG. 21.
Figure 23:
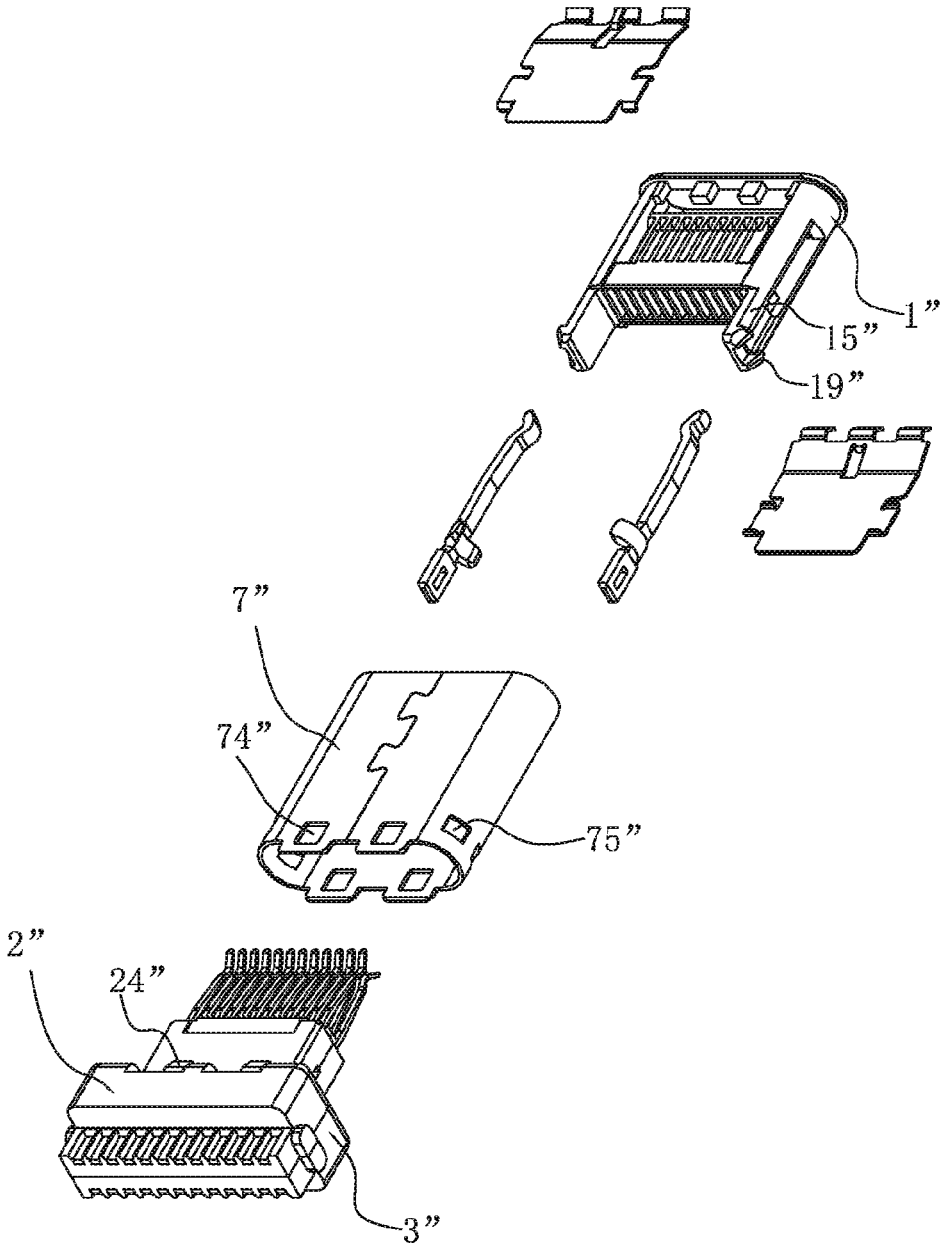
FIG. 23 is a further exploded perspective view of the electrical connector as shown in FIG. 22.

FIG. 21 through FIG. 23 is a third embodiment of the electrical connector of the present disclosure, the electrical connector is similar to the previous electrical connector 10, differences mainly lie in that: the first latching portions 19" (specifically are two hooks) of the two holding arms 15" of the insulating housing 1" are formed at two outer sides of a rear end of the electrical connector and opposite to each other, two sides of an outer shielding shell 7" each are formed with a second latching portion 75" (specifically are two openings) corresponding to the first latching portion 19", the outer shielding shell 7" and the insulating housing 1" are directly fixed and engaged together by that the second latching portion 75" latches on the first latching portion 19"; a bottom portion of the first insulating member 21" is formed with two latching protrusions 24" and a top portion of the second insulating member 31" is formed with two latching protrusions 34", the outer shielding shell 7" and a first combination (that is a combination of a first module 2", a second module 3" and a shielding piece 5") of the electrical connector are fixed together by that four latching holes 74" latch on and engage with the latching protrusions 24", 34", so that such a latching structure has advantages that the latching effect can be easily observed and engagement is secure.

What have been described above are only preferred embodiments of the present disclosure, are not used to limit the implementing solutions of the present disclosure. The person skilled in the art may conveniently make change or modification based on the main concept and spirit of the present disclosure, therefore the protective scope of the present disclosure is determined by the protective scope claimed by the claims.

What is claimed is:

1. An electrical connector, which is suitable for correspondingly inserting into another mating connector, the electrical connector comprising:

an insulating housing, the insulating housing having a bottom wall, a top wall opposing the bottom wall and two side walls connected between the bottom wall and the top wall, the bottom wall, the top wall and the two side walls enclosing to form one mating cavity, the bottom wall and the top wall being respectively provided with a group of first terminal grooves and a group of second terminal grooves, each side wall being provided with one latching groove;

a first module which is provided to a rear side of the insulating housing; the first module comprising a first insulating member and a group of first conductive terminals fixed to the first insulating member, each first conductive terminal comprising a fixed portion embedded in the first insulating member, a contacting portion extending forward from the fixed portion and a tail portion extending rearward from the fixed portion, the contacting portions of the first conductive terminals being received in the first terminal grooves and protruding toward the mating cavity;

a second module which opposes the first module along an up-down direction and is engaged with the first module together; the second module comprising a second insulating member and a group of second conductive terminals fixed to the second insulating member, each second conductive terminal comprising a fixed portion embedded in the second insulating member, a contacting portion extending forward from the fixed portion and a tail portion extending rearward from the fixed portion, the contacting portions of the second conductive terminals being received in the second terminal grooves and protruding toward the mating cavity;

at least a conductive latching member, the conductive latching member comprising a fixating portion and an elastic latching portion extending forward from the fixating portion, the elastic latching portion extending into the mating cavity via the latching groove of the insulating housing;

a shielding piece which comprises a plate body and two grounding portions respectively extending from two sides of the plate body, the plate body separating the first conductive terminals from the second conductive terminals, the grounding portion contacting and electrically connecting with the conductive latching member;

at least a conductive elastic sheet, the conductive elastic sheet comprising a body mounted on an outer side of the insulating housing and a first contact portion extending inwardly from the body and extending into the mating cavity; and an outer shielding shell which encloses an outer periphery of the conductive elastic sheet, conductive latching member and insulating housing, and when the electrical connector is correspondingly inserted into another mating connector, the outer shielding shell electrically connecting with the conductive elastic sheet and/or the conductive latching member.

2. The electrical connector according to claim 1, wherein the shielding piece is clamped and fixed between the first module and the second module.

3. The electrical connector according to claim 2, wherein the plate body of the shielding piece is provided with a through hole, two engaging surfaces of the first insulating member and the second insulating member which opposes each other are respectively provided with a positioning groove and a positioning column, the positioning column correspondingly passes through the through hole and engages with the positioning groove.

4. The electrical connector according to claim 3, wherein the first module and the second module are same, the two engaging surfaces of the first insulating member and the second insulating member which opposes each other each are provided with one positioning column and one positioning groove.

5. The electrical connector according to claim 2, wherein the engaging surface of the first insulating member which opposes the second insulating member is recessed with an accommodating groove for correspondingly accommodating the shielding piece.

6. The electrical connector according to claim 5, wherein the accommodating groove comprises a first part corresponding to the plate body of the shielding piece and two second parts corresponding to the two grounding portions of the shielding piece, a groove depth of the first part is shallower than a groove depth of the second part.

7. The electrical connector according to claim 1, wherein the shielding piece is integrally engaged with the first module by insert molding.

8. The electrical connector according to claim 7, wherein the plate body of the shielding piece is formed with an engaging hole, the first insulating member is formed with an engaging portion at the engaging hole, a distal end part of the engaging portion is larger than a part of the engaging portion positioned in the engaging hole.

9. The electrical connector according to claim 1, wherein the two grounding portions of the shielding piece obliquely extend rearward and outwardly from the two sides of the plate body respectively, a gap is provided between each grounding portion and the plate body, so that each grounding portion may elastically abut the conductive latching member.

10. The electrical connector according to claim 9, wherein the electrical connector comprises two conductive latching members respectively mounted on two sides of the insulating housing, the fixating portion of each conductive latching member is provided with a latched hole, two distal ends of the two grounding portions of the shielding piece are respectively correspondingly inserted into the two latched holes; under a state that the electrical connector is inserted into the mating connector, the elastic latching portion of the conductive latching member will extend outwardly to abut the outer shielding shell and electrically connect with the outer shielding shell.

11. The electrical connector according to claim 10, wherein the fixating portion of the conductive latching member further comprises a positioning arm extending along the up-down direction, the positioning arm is corresponding clamped between a rear end of the insulating housing and the first insulating member and the second insulating member.

12. The electrical connector according to claim 1, wherein a holding arm protrudes rearward from each of the two side walls of the insulating housing, the two holding arms correspondingly clamp two sides of the first insulating member and second insulating member.

13. The electrical connector according to claim 12, wherein two inner sides of the two holding arms of the insulating housing each are formed with a hooking portion, two sides of a front end of the first insulating member each are form with a first hook engaging portion, two sides of a front end of the second insulating member each are formed with a second hook engaging portion, the first module and second module are engaged with the insulating housing by that the first hook engaging portion and the second hook engaging portion hook and engage with the hooking portion.

14. The electrical connector according to claim 13, wherein the first insulating member and the second insulating member each comprises a base portion and a protruding portion extending forward from the base portion, a front end surface of the protruding portion of the first insulating member and a front end surface of the protruding portion of the second insulating member correspondingly close a rear end of the mating cavity.

15. The electrical connector according to claim 14, wherein the electrical connector comprises the two conductive latching members respectively mounted on two sides of the insulating housing, the fixating portion of the conductive latching member comprises a positioning arm extending along the up-down direction and a fixating arm positioned at a rear side of the positioning arm and extending along a front-rear direction, the positioning arm is correspondingly clamped between a rear end of the insulating housing and a front surface of the base portion of the first insulating member and a front surface of the base portion of the second insulating member.

16. The electrical connector according to claim 15, wherein the fixating portion of the conductive latching member is provided with a latched hole, two distal ends of the two grounding portions of the shielding piece are respectively correspondingly inserted into the two latching holes; under a state that the electrical connector is inserted into the mating connector, the elastic latching portion of the conductive latching member will extend outwardly to abut the outer shielding shell and electrically connect with the outer shielding shell.

17. The electrical connector according to claim 1, wherein a rear end of the first insulating member and a rear end of the second insulating member each are formed with a soldering protruding portion, the soldering protruding portion is provided with a plurality of terminal receiving grooves, the tail portions of the first conductive terminals and the tail portions of the second conductive terminals are correspondingly received in the terminal receiving grooves by one to one, an interval between the two adjacent tail portions is larger than an interval between the two adjacent contacting portions.

18. The electrical connector according to claim 1, wherein the first insulating member and the second insulating member each have a base portion and a protruding portion extending forward from the base portion, the protruding portion of the first insulating member and the protruding portion of the second insulating member each are provided with at least a latching protrusion protruding outwardly, the outer shielding shell is correspondingly formed with at least two latching holes, the outer shielding shell is engaged with the first module and the second module by that the latching holes latch on and engage with the latching protrusions.

19. The electrical connector according to claim 18, wherein a holding arm protrudes rearward from each of the two side walls of the insulating housing, a side of the holding arm is formed with a first latching portion; two sides of a rear end of the outer shielding shell each are correspondingly formed with a second latching portion, the outer shielding shell is engaged with the insulating housing by that the second latching portion latches on and engages with the first latching portion.

20. The electrical connector according to claim 19, wherein the two first latching portions are provided to two outer sides of the two holding arms, opposite to each other and protrude outwardly, the second latching portion is a latching opening opened to the outer shielding shell.

21. The electrical connector according to claim 1, wherein the conductive elastic sheet further comprises a second contact portion extending from the body toward the outer shielding shell, the second contact portion is separated from the outer shielding shell under a state that the electrical connector is not inserted into the mating connector; and under a state that the electrical connector is inserted into the mating connector, the second contact portion is displaced outwardly to electrically contact the outer shielding shell.

22. The electrical connector according to claim 21, wherein the body conductive elastic sheet comprises a first section which is flat and a second section obliquely extending from a front edge of the first section toward the mating cavity, the first contact portion bends from a front edge of the second section of the body and further extends toward the inside of the mating cavity, the second contact portion bends from the second section of the body and extends toward the outer shielding shell.

23. The electrical connector according to claim 22, wherein two sides of the first section of the body of the conductive elastic sheet each are formed with a positioning portion, the positioning portion is used to position on the bottom wall/the top wall of the insulating housing.

24. The electrical connector according to claim 23, wherein the middle of the first section of the body of the conductive elastic sheet is formed with at least a mounting hole, the insulating housing is provided with at least a mounting column corresponding to the mounting hole.

25. The electrical connector according to claim 23, wherein each positioning portion comprises two latching claws bending downward from a side surface of the body and extending downward, the two latching claws oppose each other and can correspondingly grasp the bottom wall/the top wall of the insulating housing.

26. The electrical connector according to claim 22, wherein the first section of the body of the conductive elastic sheet is attached on an inner side of the outer shielding shell, electrically connects with the outer shielding shell.

27. A cable connector, the cable connector comprising the electrical connector according to claim 1, a shielding shell mounted on a rear end of the electrical connector, an insulating outer shell covering an outer periphery of the shielding shell and a cable electrically connecting with the electrical connector together.

28. The cable connector according to claim 27, wherein the shielding shell comprises a lower shell and an upper shell which are engaged with each other, a front end of the lower shell and a front end of the upper shell each formed with a latching portion so that the latching portion of the lower shell and the latching portion of the upper shell oppose each other; a bottom portion and a top portion of the outer shielding shell of the electrical connector each are formed with a latching hole, the latching portions of the shielding shell are correspondingly inserted into the latching holes.

29. The cable connector according to claim 28, wherein the first insulating member and the second insulating member each are provided with a latched groove corresponding to the latching hole, the latching portion of the shielding shell is further inserted into the latched groove.

* * * * *